US011491803B2

(12) United States Patent
Bourgeois et al.

(10) Patent No.: US 11,491,803 B2
(45) **Date of Patent: *Nov. 8, 2022**

(54) METHOD AND APPARATUS FOR APPLYING A MATERIAL ONTO ARTICLES USING A TRANSFER COMPONENT

(71) Applicant: The Procter & Gamble Company, Cincinnati, OH (US)

(72) Inventors: Marc Richard Bourgeois, Liberty Township, OH (US); Matthew Richard Allen, Mason, OH (US); Mark Mason Hargett, Liberty Township, OH (US); Benjamin Jacob Clare, Cincinnati, OH (US); Philip Andrew Sawin, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/787,064

(22) Filed: Feb. 11, 2020

(65) Prior Publication Data

US 2020/0254752 A1 Aug. 13, 2020

Related U.S. Application Data

(60) Provisional application No. 62/804,318, filed on Feb. 12, 2019.

(51) Int. Cl.
*B41J 3/407* (2006.01)
*B41M 5/025* (2006.01)
(Continued)

(52) U.S. Cl.
CPC ..... *B41J 3/4073* (2013.01); *B41F 16/006* (2013.01); *B41F 16/008* (2013.01);
(Continued)

(58) Field of Classification Search
None
See application file for complete search history.

(56) References Cited

U.S. PATENT DOCUMENTS 2,134,041 A 10/1938 Hamm
2,461,281 A * 2/1949 Jackson ..... B41F 15/0872 101/123
(Continued)

FOREIGN PATENT DOCUMENTS

CA 2236911 A1 11/1998
CN 1271319 A 10/2000
(Continued)

OTHER PUBLICATIONS

US 9,193,175 B2, 11/2015, Kraus (withdrawn)
(Continued)

*Primary Examiner* — Jill E Culler
(74) *Attorney, Agent, or Firm* — Steven Robert Chuey; Sarah M DeCristofaro

(57) ABSTRACT

Apparatuses and methods for applying a transfer material onto one or more surfaces of an article are disclosed, including apparatuses and methods of transfer printing on and/or decorating three-dimensional articles, as well as the articles printed and/or decorated thereby. The apparatuses and methods may include providing a deposition device, such as a printing device; providing a transfer component; depositing a material onto a portion of the transfer component with the deposition device; modifying the portion of the transfer component with the transfer material thereon to conform the transfer component to at least a portion of one or more surfaces of the three-dimensional article; and transferring the transfer material onto the one or more surfaces of the article.

6 Claims, 15 Drawing Sheets

(51) Int. Cl.

| | |
|---|---|
| ***B41F 16/00*** | (2006.01) |
| ***B41J 2/01*** | (2006.01) |
| ***B41J 13/22*** | (2006.01) |
| ***B41M 1/40*** | (2006.01) |

(52) U.S. Cl.

CPC ..... *B41F 16/0086* (2013.01); *B41J 2/01* (2013.01); *B41J 3/40733* (2020.08); *B41J 13/22* (2013.01); *B41M 1/40* (2013.01); *B41M 5/025* (2013.01); *B41J 2002/012* (2013.01)

(56) References Cited

U.S. PATENT DOCUMENTS 3,276,356 A 10/1966 Usko et al.
3,313,667 A 4/1967 Flood
3,418,926 A 12/1968 Ichiro
3,434,902 A 3/1969 Bliss
3,483,063 A 12/1969 Baines
3,587,455 A 6/1971 Childress et al.
3,653,176 A 4/1972 Gess
4,129,473 A 12/1978 Perret
4,180,105 A 12/1979 Harvey
4,201,621 A 5/1980 Crankshaw
4,214,937 A 7/1980 Geurtsen
4,315,795 A 2/1982 Jodrey
4,342,399 A 8/1982 Stirling
4,349,402 A 9/1982 Parker
4,405,403 A 9/1983 Jodrey
4,583,460 A 4/1986 Maslin
4,594,123 A 6/1986 Eder
4,769,100 A 9/1988 Short et al.
4,828,637 A 5/1989 Mentzer et al.
4,838,973 A 6/1989 Mentzer et al.
4,960,482 A 10/1990 Crane et al.
5,104,719 A 4/1992 Kamen et al.
5,116,452 A 5/1992 Eder
5,259,912 A 11/1993 Cline
5,385,252 A 1/1995 Hidding
5,388,695 A 2/1995 Gilbert
5,413,651 A 5/1995 Otruba
5,565,055 A * 10/1996 Croci ..... B65C 3/16 156/238
5,674,345 A 10/1997 Nash
5,832,819 A 11/1998 Widman
6,070,524 A 6/2000 Marroquin-garza
6,110,316 A 8/2000 Kobayashi et al.
6,119,751 A 9/2000 Nilsen et al.
6,135,654 A 10/2000 Jennel
6,143,407 A 11/2000 Lythgoe et al.
6,164,199 A * 12/2000 Dubuit ..... B41F 15/0872 101/124
6,250,316 B1 6/2001 Brandt et al.
6,491,782 B1 12/2002 Jaynes
6,565,968 B1 5/2003 Li
6,578,476 B2 6/2003 Liguori et al.
6,584,894 B1 7/2003 Mason
6,699,352 B2 3/2004 Sawatsky
6,736,055 B2 5/2004 Lutz et al.
6,835,268 B2 12/2004 Widman
6,920,822 B2 7/2005 Finan
6,957,030 B2 10/2005 Baker, Jr. et al.
7,011,728 B2 3/2006 Dewig et al.
7,014,895 B1 3/2006 Grotefend
7,048,651 B2 5/2006 Kennedy, III et al.
7,210,408 B2 5/2007 Uptergrove
7,220,333 B1 5/2007 Bethune
7,261,033 B2 * 8/2007 Dubuit ..... B41F 15/0872 101/40.1
7,290,803 B2 11/2007 Scarbrough et al.
7,373,878 B2 5/2008 Finan
7,448,323 B2 11/2008 Kennedy, III et al.
7,467,847 B2 12/2008 Baxter et al.
7,556,708 B2 7/2009 Phillips
7,625,059 B2 12/2009 Uptergrove
7,704,345 B2 4/2010 Bosshardt
7,736,713 B2 * 6/2010 Uptergrove ..... B41J 3/543 428/35.7
7,765,931 B2 8/2010 Kennedy, III et al.
7,815,761 B2 10/2010 Phillips
7,874,339 B2 1/2011 France
7,887,176 B2 2/2011 Kovacs et al.
7,891,799 B2 2/2011 Edwards
8,192,010 B2 6/2012 Edwards
D663,622 S 7/2012 Diss
8,233,829 B2 7/2012 Miyazaki
8,317,311 B2 11/2012 Edwards
8,323,438 B2 12/2012 Roof et al.
8,430,498 B2 4/2013 Edwards
8,477,163 B2 7/2013 Hirst
8,522,989 B2 9/2013 Uptergrove
8,551,270 B2 10/2013 Previty et al.
8,579,402 B2 11/2013 Uptergrove
8,616,259 B1 12/2013 Woods et al.
8,628,187 B2 1/2014 Roof et al.
8,667,895 B2 3/2014 Gerigk et al.
8,714,731 B2 5/2014 Leung et al.
8,740,367 B2 6/2014 Edwards
8,814,346 B2 8/2014 Edwards
8,851,136 B1 10/2014 Drynkin et al.
8,876,979 B2 11/2014 Uptergrove et al.
8,889,232 B2 11/2014 Cong
8,899,739 B2 12/2014 Ohnishi
8,919,247 B2 12/2014 Morgavi et al.
8,943,968 B2 2/2015 Tanaka et al.
8,993,219 B2 3/2015 Richert et al.
9,032,872 B2 * 5/2015 Uptergrove ..... B41J 3/4073 101/38.1
9,079,351 B2 7/2015 Turner et al.
9,090,090 B2 7/2015 Putzer et al.
9,132,664 B2 9/2015 Schach
9,144,957 B2 9/2015 Lee
9,150,325 B2 10/2015 Uptergrove et al.
9,156,134 B2 10/2015 Kim
9,211,966 B2 12/2015 Broad
9,221,573 B2 12/2015 Lorence et al.
9,254,687 B2 * 2/2016 Ohnishi ..... B41M 3/12
9,272,534 B2 3/2016 Domeier et al.
9,290,016 B2 3/2016 Landa et al.
9,303,185 B2 4/2016 Sambhy et al.
9,403,357 B1 8/2016 Robinson et al.
9,475,327 B2 10/2016 Izawa
9,487,027 B1 11/2016 Strater, Jr. et al.
9,517,618 B2 12/2016 Landa et al.
9,708,509 B2 7/2017 Zajaczkowski
10,035,338 B2 7/2018 Howard
10,144,225 B2 * 12/2018 Koers ..... B41M 1/40
10,214,655 B2 2/2019 Liu
2001/0030021 A1 10/2001 Romig
2002/0168212 A1 11/2002 Nedblake, Jr. et al.
2003/0102078 A1 6/2003 Dabrowski
2005/0098269 A1 5/2005 Ballarotti
2005/0167035 A1 8/2005 Laskey et al.
2005/0274687 A1 12/2005 McCutchan
2006/0018698 A1 1/2006 Vogt
2006/0194024 A1 8/2006 Nakayama
2006/0254445 A1 11/2006 Masuda
2007/0019049 A1 1/2007 Heiman et al.
2007/0098933 A1 5/2007 Opuszko et al.
2007/0157576 A1 7/2007 Till
2007/0254121 A1 11/2007 Cerveny
2008/0043087 A1 2/2008 Cowan
2008/0197540 A1 8/2008 McAllister et al.
2008/0216692 A1 9/2008 Zaher
2009/0000733 A1 1/2009 Berndtsson
2009/0056858 A1 3/2009 Davila Casitas et al.
2009/0207198 A1 8/2009 Muraoka
2010/0038022 A1 2/2010 Lapelosa
2010/0039487 A1 2/2010 Sawatsky
2010/0091057 A1 4/2010 Kennedy, III et al.
2010/0096386 A1 4/2010 Uptergrove et al.
2010/0212821 A1 8/2010 Grinberg et al.
2010/0257819 A1 10/2010 Schach
2010/0307692 A1 12/2010 Lorence et al.
2011/0067584 A1 3/2011 Mueller et al.

(56) References Cited

U.S. PATENT DOCUMENTS

| | | | |
|---|---|---|---|
| 2011/0223362 | A1 | 9/2011 | Van |
| 2011/0232514 | A1 | 9/2011 | Putzer et al. |
| 2011/0250412 | A1 | 10/2011 | Johnson et al. |
| 2012/0031548 | A1 | 2/2012 | Broad |
| 2012/0061014 | A1 | 3/2012 | Patel et al. |
| 2012/0210894 | A1 | 8/2012 | Nagase |
| 2013/0019566 | A1 | 1/2013 | Schach |
| 2013/0075040 | A1 | 3/2013 | Grinberg et al. |
| 2013/0193022 | A1 | 8/2013 | Uptergrove |
| 2013/0206328 | A1 | 8/2013 | Chiu et al. |
| 2013/0242016 | A1 | 9/2013 | Tennis |
| 2013/0314470 | A1 | 11/2013 | Igawa |
| 2014/0109828 | A1 | 4/2014 | Grinberg |
| 2014/0285600 | A1 | 9/2014 | Domeier et al. |
| 2014/0302289 | A1 | 10/2014 | Duzy et al. |
| 2014/0338840 | A1 | 11/2014 | Lux et al. |
| 2015/0020949 | A1 | 1/2015 | Howard |
| 2015/0022602 | A1 | 1/2015 | Landa et al. |
| 2015/0024648 | A1 | 1/2015 | Landa et al. |
| 2015/0144517 | A1 | 5/2015 | Allen |
| 2015/0183544 | A1 | 7/2015 | Moffatt et al. |
| 2015/0189953 | A1 | 7/2015 | Langvin |
| 2015/0217550 | A1 | 8/2015 | Gosnell et al. |
| 2015/0314580 | A1 | 11/2015 | Sato et al. |
| 2015/0343761 | A1 | 12/2015 | Roeder et al. |
| 2015/0343762 | A1 | 12/2015 | Shaul et al. |
| 2016/0129680 | A1 | 5/2016 | Ikeda et al. |
| 2016/0222228 | A1 | 8/2016 | Uptergrove et al. |
| 2017/0182513 | A1 | 6/2017 | Cassoni et al. |
| 2017/0182704 | A1 | 6/2017 | Allen et al. |
| 2017/0182705 | A1 | 6/2017 | Allen et al. |
| 2017/0182756 | A1 | 6/2017 | Cassoni et al. |
| 2017/0183124 | A1 | 6/2017 | Allen |
| 2017/0203557 | A1 | 7/2017 | Cho et al. |
| 2018/0272682 | A1 | 9/2018 | Allen |
| 2019/0337304 | A1 | 11/2019 | Allen |
| 2020/0047419 | A1 | 2/2020 | Allen |
| 2020/0254751 | A1 | 8/2020 | Cassoni |
| 2020/0254792 | A1 | 8/2020 | Cassoni |
| 2020/0254802 | A1 | 8/2020 | Cassoni |
| 2020/0254803 | A1 | 8/2020 | Cassoni |

FOREIGN PATENT DOCUMENTS

| | | | | |
|---|---|---|---|---|
| CN | 2818150 | Y | 9/2006 | |
| CN | 101406874 | A | 4/2009 | |
| CN | 201234412 | Y | 5/2009 | |
| CN | 101554933 | A | 10/2009 | |
| CN | 101574875 | A | 11/2009 | |
| CN | 201475524 | U | 5/2010 | |
| CN | 101734033 | A | 6/2010 | |
| CN | 101827711 | A | 9/2010 | |
| CN | 102423962 | A | 4/2012 | |
| CN | 202319287 | U | 7/2012 | |
| CN | 203818720 | U | 9/2014 | |
| CN | 105125347 | A | 12/2015 | |
| CN | 204896036 | U | 12/2015 | |
| CN | 105328988 | A | 2/2016 | |
| CN | 105691018 | A | 6/2016 | |
| CN | 106103125 | A | 11/2016 | |
| CN | 106113959 | A | 11/2016 | |
| CN | 107073992 | A | 8/2017 | |
| DE | 3241041 | A1 | 5/1984 | |
| DE | 10337402 | | 3/2005 | |
| DE | 102015104321 | | 9/2016 | |
| EP | 0076593 | | 4/1983 | |
| EP | 0974524 | A1 | 1/2000 | |
| EP | 1163156 | B1 | 11/2003 | |
| EP | 2329954 | | 11/2010 | |
| EP | 3006220 | A1 | 4/2016 | |
| GB | 827313 | | 3/1960 | |
| GB | 898153 | | 6/1962 | |
| GB | 2236508 | A | 4/1991 | |
| GB | 2259888 | A | 3/1993 | |
| GB | 2368313 | B | 3/2004 | |
| JP | 2007283716 | | 11/2007 | |
| JP | 2013216013 | | 10/2013 | |
| JP | 2014223750 | A | 12/2014 | |
| JP | 6510102 | B1 * | 5/2019 | ..... A61J 3/06 |
| WO | WO200020219 | A1 | 4/2000 | |
| WO | WO200112440 | A1 | 2/2001 | |
| WO | WO2006005607 | A1 | 1/2006 | |
| WO | 2008026926 | A1 | 3/2008 | |
| WO | 2009031854 | A2 | 3/2009 | |
| WO | WO2015105635 | A1 | 7/2015 | |
| WO | WO2015143296 | A1 | 9/2015 | |
| WO | WO2016075446 | A1 | 5/2016 | |

OTHER PUBLICATIONS

Extended European Search Report; Appl. No. 20156501.7; dated Jul. 14, 2020, 10 pages.
Extended European Search Report; Appl. No. 20156503.3; dated Jul. 15, 2020, 12 pages.
Extended European Search Report; Appl. No. 20156508.2; dated Jun. 8, 2020, 9 pages.
Extended European Search Report; Appl. No. 20156509.0; dated Jul. 15, 2020, 9 pages.
Extended European Search Report; Appl. No. 20156515.7; dated Jul. 15, 2020, 10 pages.
International Search Report and Written Opinion dated Aug. 31, 2017, U.S. Appl. No. 15/375,208, 14 pgs.
International Search Report and Written Opinion dated Mar. 20, 2017, U.S. Appl. No. 15/375,204, 19 pgs.
International Search Report and Written Opinion dated Mar. 20, 2017, U.S. Appl. No. 15/375,210, 16 pgs.
International Search Report and Written Opinion dated Mar. 20, 2017, U.S. Appl. No. 15/375,211, 16 pgs.
International Search Report and Written Opinion dated Mar. 20, 2017, U.S. Appl. No. 15/375,214, 14 pgs.
Xeikon "Labels & Packaging Heat Transfer Label Suite", brochure dated 2012, published by Xeikon International BV, Netherlands.
Non-Final Rejection dated Aug. 27, 2018; U.S. Appl. No. 15/375,204.
Final Rejection dated Feb. 13, 2019; U.S. Appl. No. 15/375,204.
Non-Final Rejection dated Aug. 16, 2019; U.S. Appl. No. 15/375,204.
Final Rejection dated Jan. 28, 2020; U.S. Appl. No. 15/375,204.
Non-Final Rejection dated Aug. 3, 2020; U.S. Appl. No. 15/375,204.
Non-Final Rejection dated Jun. 13, 2019; U.S. Appl. No. 15/375,208.
Final Rejection dated Dec. 31, 2019; U.S. Appl. No. 15/375,208.
Non-Final Rejection dated Apr. 29, 2020; U.S. Appl. No. 15/375,208.
Final Rejection dated Oct. 15, 2020; U.S. Appl. No. 15/375,208.
Non-Final Rejection dated Sep. 18, 2017; U.S. Appl. No. 15/375,210.
Final Rejection dated Mar. 13, 2018; U.S. Appl. No. 15/375,210.
Non-Final Rejection dated Jul. 18, 2018; U.S. Appl. No. 15/375,210.
Final Rejection dated Jan. 7, 2019; U.S. Appl. No. 15/375,210.
Non-Final Rejection dated Jul. 8, 2019; U.S. Appl. No. 15/375,210.
Final Rejection dated Dec. 9, 2019; U.S. Appl. No. 15/375,210.
Non-Final Rejection dated May 20, 2020; U.S. Appl. No. 15/375,210.
Non-Final Rejection dated Jul. 9, 2018; U.S. Appl. No. 15/375,211.
Final Rejection dated Jan. 8, 2019; U.S. Appl. No. 15/375,211.
Non-Final Rejection dated Apr. 29, 2019; U.S. Appl. No. 15/375,211.
Notice of Allowance dated Aug. 8, 2019; U.S. Appl. No. 15/375,214.
Notice of Allowance dated Sep. 9, 2019; U.S. Appl. No. 15/375,214.
Notice of Allowance dated Oct. 21, 2019; U.S. Appl. No. 15/375,214.
Notice of Allowance dated Dec. 27, 2019; U.S. Appl. No. 16/658,427.
Notice of Allowance dated Mar. 2, 2020; U.S. Appl. No. 16/658,427.
Notice of Allowance dated Apr. 9, 2020; U.S. Appl. No. 16/658,427.
Non-Final Rejection dated Aug. 28, 2018; U.S. Appl. No. 15/992,265.
Final Rejection dated Feb. 13, 2019; U.S. Appl. No. 15/992,265.
Non-Final Rejection dated Aug. 19, 2019; U.S. Appl. No. 15/992,265.
Final Rejection dated Jan. 29, 2020; U.S. Appl. No. 15/992,265.
Non-Final Rejection dated Aug. 5, 2020; U.S. Appl. No. 15/992,265.
Non-Final Rejection dated Oct. 7, 2020, U.S. Appl. No. 16/787,061.
Non-Final Rejection dated Oct. 7, 2020, U.S. Appl. No. 16/787,062.

(56) References Cited

OTHER PUBLICATIONS

Non-Final Rejection dated Oct. 7, 2020, U.S. Appl. No. 16/787,065.
Non-Final Rejection dated Oct. 7, 2020, U.S. Appl. No. 16/787,069.
All Office Actions, U.S. Appl. No. 17/191,746.

* cited by examiner

METHOD AND APPARATUS FOR APPLYING A MATERIAL ONTO ARTICLES USING A TRANSFER COMPONENT

FIELD

The present invention is directed to apparatuses and methods for applying a transfer material onto an article, including apparatuses and methods of transfer printing onto and/or decorating three-dimensional articles, as well as the articles having the transfer material thereon and/or which are decorated thereby.

BACKGROUND

Various apparatuses and methods of printing are disclosed in the patent literature and on the internet. Patent publications disclosing apparatuses and methods of printing include: U.S. Pat. No. 6,135,654, Jennel; U.S. Pat. No. 6,699,352 B2, Sawatsky; U.S. Pat. No. 6,920,822 B2, Finan; U.S. Pat. No. 7,210,408 B2, Uptergrove; U.S. Pat. No. 7,373,878 B2, Finan; U.S. Pat. No. 7,467,847 B2, Baxter, et al.; U.S. Pat. No. 8,522,989 B2, Uptergrove; U.S. Pat. No. 8,579,402 B2, Uptergrove; U.S. Pat. No. 8,667,895 B2, Gerigk, et al.; U.S. Pat. No. 8,714,731 B2, Leung, et al.; U.S. Pat. No. 8,899,739 B2, Ohnishi; U.S. Pat. No. 8,919,247 B2; Mogavi, et al.; U.S. Pat. No. 9,303,185 B2, Sambhy, et al.; and US Patent Application Publication Nos. US 2009/0207198 A1, Muraoka; US 2011/0232514 A1, Putzer, et al.; US 2013/0019566 A1, Schach; US 2014/0285600 A1, Domeier, et al.; US 2015/0022602 A1, Landa, et al.; US 2015/0024648 A1, Landa, et al.; and EP 1163156 B1, Johnson. Other types of apparatuses and methods include the apparatus and method disclosed in U.S. Patent Application Pub No. US 2012/0031548 A1, "Apparatus and Method for Applying a Label to a Non-Ruled Surface", filed in the name of Broad.

A number of current efforts are being directed to printing, particularly inkjet printing, on three-dimensional articles such as bottles and the like. Some current printing apparatuses and processes use ink jet printing to print directly on three-dimensional articles. Unfortunately, with current inkjet technology and current printing apparatuses, the quality of labels that may be formed by printing directly on three-dimensional articles is not as good as that formed on separately printed flat labels. Further, such printing processes may only be able to accurately jet ink short distances (e.g., several millimeters) from the print head. Therefore, if the article has surface features that differ in height or depth by more than such short distances, the ink jetted by an ink jet print head will not be accurately applied, leading to defects in print quality.

Other processes for applying ink to three-dimensional articles are transfer processes. In these processes, ink is first applied to a transfer surface, and then the image is transferred from the transfer surface to the article. Current transfer processes suffer from the disadvantage that they are not well suited to transfer the image from the transfer surface to articles with complex three-dimensional shapes and/or which have surface features that differ in height (or depth) by more than a limited extent.

It would be desirable to have improved apparatuses and methods for applying a transfer material or other materials onto three-dimensional articles.

SUMMARY

The present disclosure is directed to apparatuses and methods for applying a transfer material onto the surface of an article, including apparatuses and methods, also referred to herein as processes, of transfer printing onto and/or decorating three-dimensional articles, as well as the articles having the transfer material thereon and/or which are decorated thereby.

A method may include providing at least one three-dimensional article which has a surface; providing a deposition device; providing a transfer component; depositing at least one material onto a portion of the surface of the transfer component with the deposition device to form a transfer material on said transfer component; modifying the portion of the transfer component with the transfer material thereon to conform that portion of the transfer component to at least a portion of one or more surfaces of the three-dimensional article; and transferring the transfer material onto the surface of the article.

A method for decorating an article may include: traversing an array of cavities in a machine direction; traversing a transfer component in the machine direction, wherein the transfer component comprises a first transfer material and a second transfer material; loading a first article into a first cavity of the array of cavities; transferring the first transfer material from the transfer component to a first face of the first article; rotating the first article about an axis; and transferring the second transfer material from the transfer component to a second face of the first article.

A method for decorating an article may include: traversing an array of cavities about a central axis in a machine direction; loading a first article into a first cavity of the array of cavities; decorating a first face of the first article during a first revolution about the central axis; rotating the first article about a first axis; and decorating a second face of the first article during a second revolution about the central axis.

A method for decorating an article may include: traversing an array of cavities in a machine direction; traversing a transfer component in the machine direction, wherein the transfer component comprises a first transfer material and a second transfer material; loading a first article into a first cavity of the array of cavities; transferring the first transfer material to a first face of the first article during a first revolution; rotating the first article about a first axis; and transferring a second material to a second face of the first article during a second revolution.

The transfer component may be continuous. There may be variations in modifying the portion of the transfer component with the transfer material thereon. For example, the transfer material may be deformed, such as by stretching, to engage the article and may be conformed to one or more surfaces or a face of the article. The portion of the transfer component with the transfer material thereon may be modified in various different sequences relative to contacting the article (or being contacted by the article), including: prior to contact with the article; simultaneously to contact with the article; after initial contact with the article; and, combinations thereof. Several different types of mechanisms may be used to modify the transfer component.

The apparatus for carrying out the process may comprise one or more functional devices. The function(s) may be performed on the transfer component to create the transfer material that is transferred to the articles. The functional devices may include, but are not limited to: one or more deposition devices; optional devices such as adhesive deposition devices; devices for treating articles (e.g., devices for treating the surface of articles, or for curing substances applied to the articles); devices for embellishing articles (e.g., application of a metal foil); or combinations thereof.

The articles may be decorated by a transfer device including an array of cavities. Each cavity of the array of cavities may be configured to receive, hold, position, and release the article. Each cavity of the array of cavities may be joined to the transfer device. The transfer device may be used to traverse the array of cavities such that each cavity of the array of cavities is positioned in facing relationship with the transfer component, and, more specifically, the transfer material disposed on the transfer material is positioned such that the transfer material may be transferred to an article held by a cavity. Multiple surfaces of the article may be decorated during a single engagement and transfer of the transfer material to the article. The article may undergo transfer of the transfer material from the transfer component to the article multiple times to decorate the article. For example, the article may complete a first revolution about the transfer device and any number of subsequent revolutions of the transfer device to decorate one or more faces of the article.

The transfer device may be configured for continuous loading and unloading of articles. One cavity may be unloaded while the adjacent cavity traverses past the unload station. Thus, the cavities are loaded and unloaded in an alternating pattern. Other unloading and loading patterns may also be used depending, in part, on the article to be decorated and manufacturing parameters, such as line speed and processing time.

The articles having the transfer material thereon and/or which are decorated by the processes may comprise any suitable three-dimensional articles.

These and additional features will be more fully disclosed in the following detailed description in conjunction with the drawings.

Figure 1A:
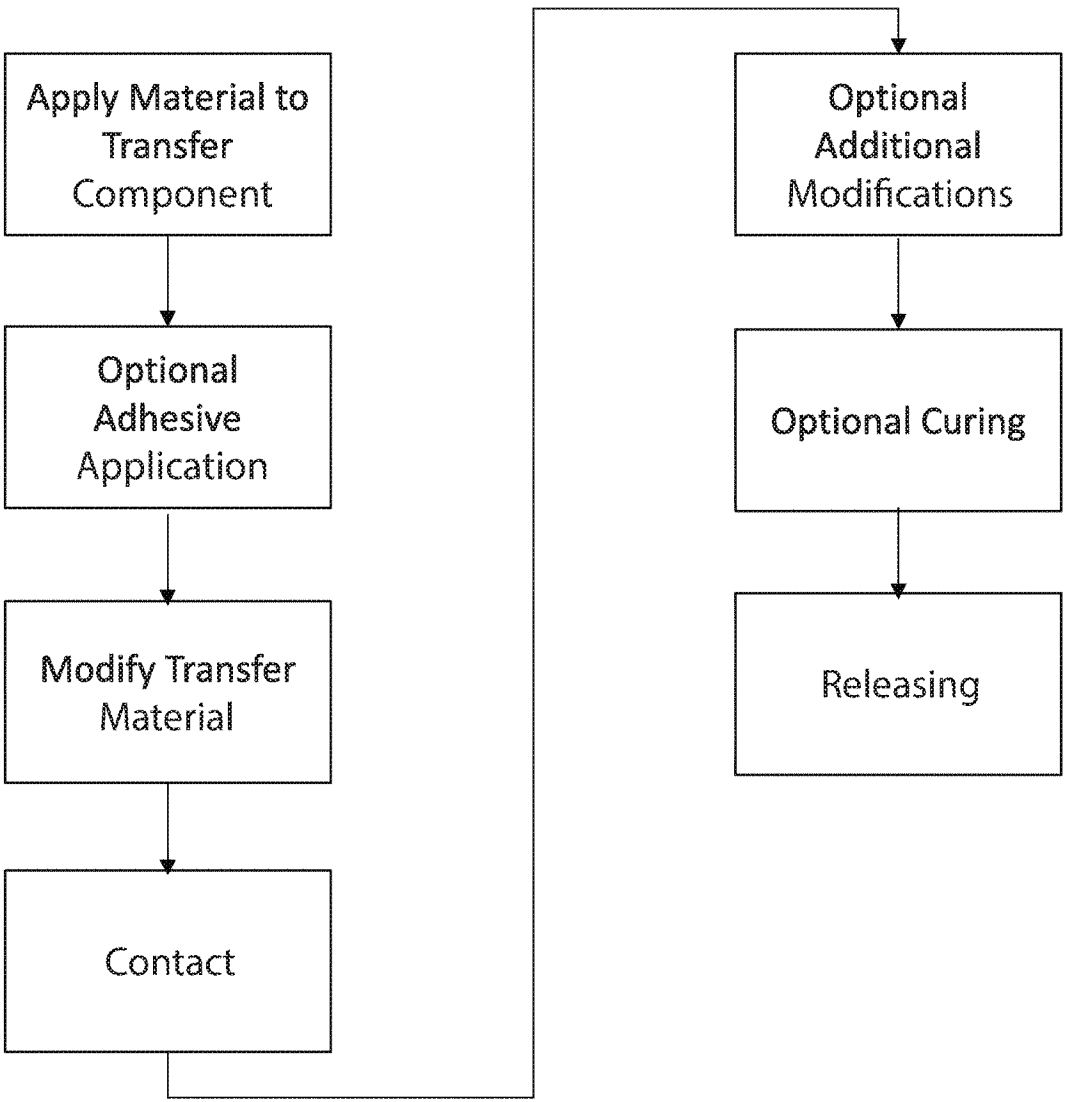
FIG. 1A is a flow chart illustrating a process for applying a transfer material onto an article.

The method, apparatus(es), and articles shown in the drawings are illustrative in nature and are not intended to be limiting of the invention defined by the claims. Moreover, the features of the invention will be more fully apparent and understood in view of the detailed description.

DETAILED DESCRIPTION

The present disclosure is directed to apparatuses and methods for applying a transfer material onto the surface of an article, including apparatuses and methods of transfer printing onto and/or decorating three-dimensional articles, as well as the articles having the transfer material thereon and/or are decorated thereby. The term "process" may be used herein interchangeably with the term "method".

FIG. 1A is a flow chart illustrating an example of a process for applying a transfer material onto the surface of a three-dimensional article. The process may include: (1) applying a transfer material to a transfer component (for example, by digitally printing a predetermined pattern including an image, text, words, symbols, or other aesthetics features onto the transfer component); (2) optionally applying an adhesive to the transfer component; (3) modifying a portion of the transfer component containing the transfer material as well as the transfer material (such as by stretching the same); (4) contacting the surface of the article with the transfer material using the transfer component (by moving at least one of the article or transfer component toward the other); (5) optionally performing an additional physical modification on the transfer component and transfer material thereon (such as by vacuum, air jets, fluid jets or combinations thereof) to bring the transfer component into closer contact with the surface of the article; (6) optionally curing the transfer material; and (7) transferring the transfer material from the transfer component to the article and releasing the transfer component from (indirect contact with) the surface of the article.

The term "transfer material", as used herein, will be used to describe the material that is transferred from the transfer component to the surface of the article. This term is inclusive of a material alone, or a combination of materials, any adhesive thereon, or other material(s) joined thereto that will be transferred to the surface of the article. The term "substance" may be used interchangeably with the term "material" herein with reference to the material(s) that are deposited on the transfer component and which will form all or part of the transfer material. Typically, one or more discrete or separate transfer materials will be transferred to each article 10.

Figure 1B:
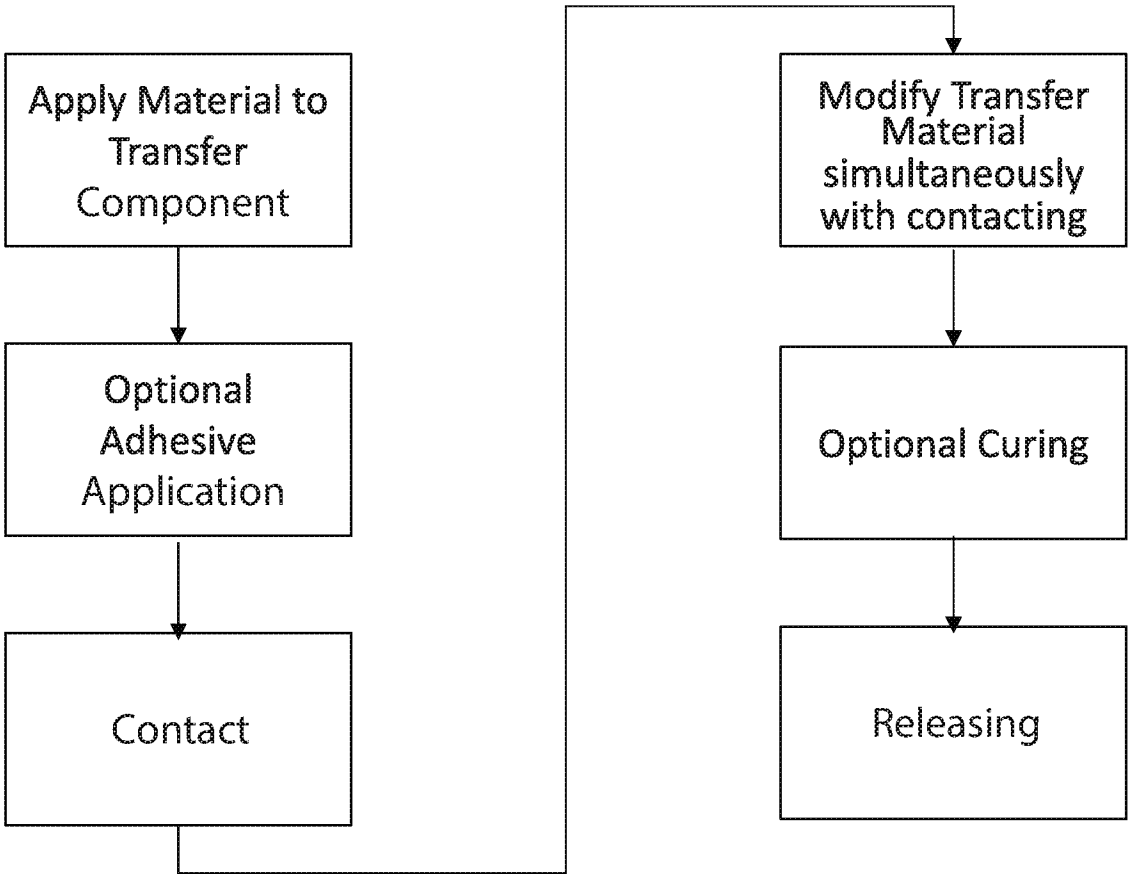
FIG. 1B is a flow chart illustrating a process for applying a transfer material onto an article.

FIG. 1B is a flow chart illustrating an example of a process for applying a transfer material onto the surface of a three-dimensional article. At least some portions of the modifying and contacting steps may occur simultaneously. More specifically, the three-dimensional article may be brought into contact with the transfer component, and the transfer component with the transfer material thereon may be modified simultaneously with the step of contacting. In such a case, for example, the transfer component may be a web which is held in tension, and the three-dimensional article may be forced into contact with the web to conform the web to the surface of the article. The term "conform", as used herein, does not require exact conformity, and includes partial conformity. There may, however, be aspects of the step of modifying the transfer component that are not necessarily simultaneous. For example, some aspects of modifying the portion of the transfer components with transfer material thereon may take place before contacting the article, and then additional modification of the transfer components with transfer material thereon may take place simultaneously with or after contacting the article. For instance, the initial modification of the transfer component with the transfer material may occur through simultaneous contact. This may be followed by a supplementary modification (e.g., positive pressure air or vacuum) that may be subsequent to the initial contact rather than simultaneous. Such a subsequent modification may be performed prior to any optional curing and releasing. The order of the modifying and contacting steps may be reversed. For example, the article may contact the transfer component, at least for a period of time, before any modification occurs. Thereafter, the article may be forced into contact with the transfer component, also referred to herein as a web, to conform the transfer component to the surface of the article.

Numerous variations of the order of steps of these processes, as well as mechanisms to carry out the processes, are possible. The order in which the steps take place may be varied, and/or the steps and/or portions of the different processes may be combined in any suitable manner. In addition, any other suitable steps may be added to any of these processes. Suitable additional steps may include, but are not limited to: applying a release coating to the transfer component prior to depositing a transfer material thereon; treating the surface of articles, or curing materials applied to the articles; additionally, embellishing the articles with additional materials (e.g., by the application of a metal material); transforming a property of an article (e.g., by laser); or combinations thereof. In addition, if a reusable transfer component is used, the processes may further include cleaning the transfer component after the releasing step. Such additional steps may be added, as appropriate, to either the front end and/or the back end of the processes of the categories shown in FIGS. 1A and 1B, and/or at any suitable place between any of the steps shown therein.

Figure 2:
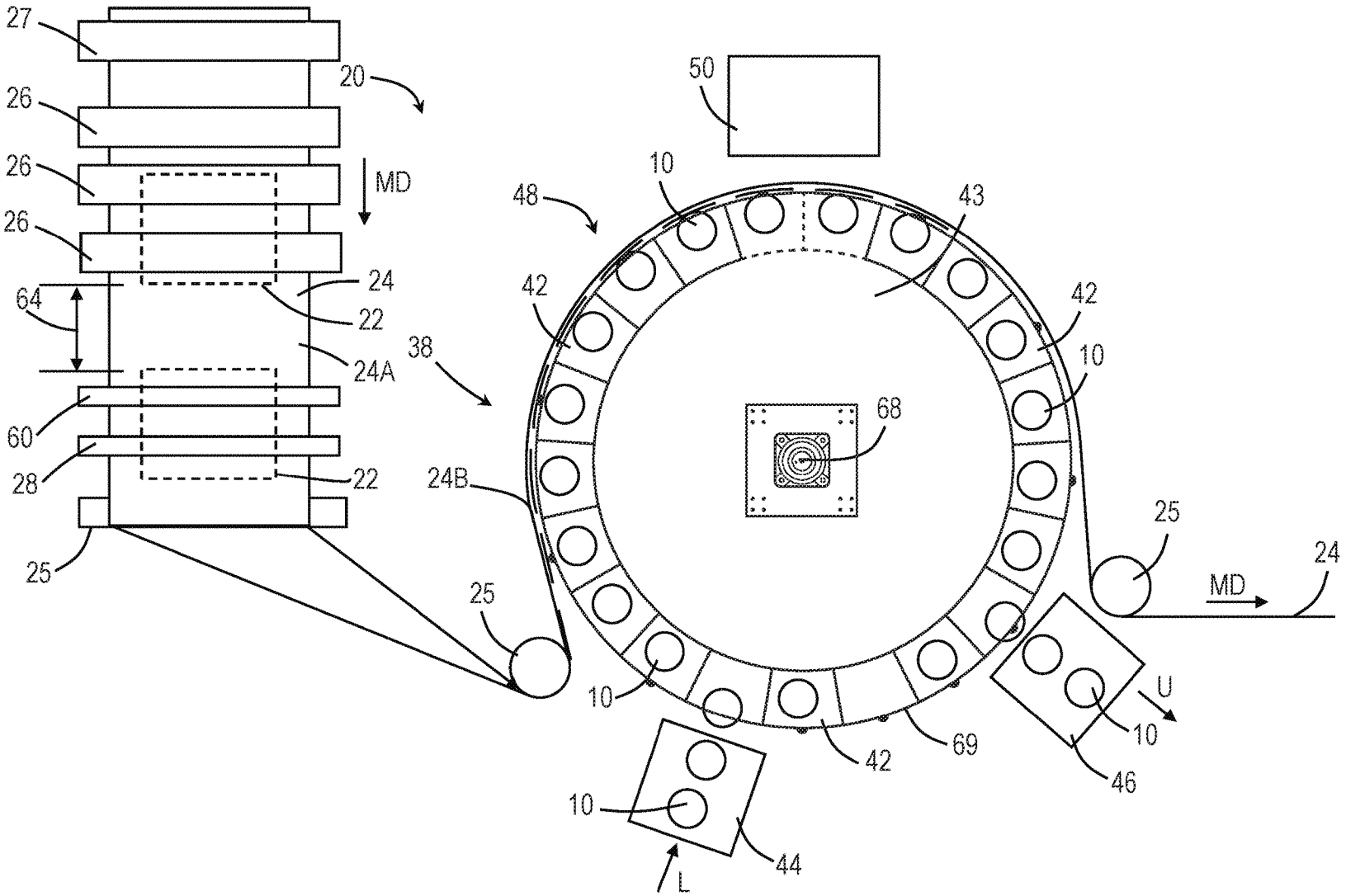
FIG. 2 is a schematic top view of an apparatus for applying a transfer material onto an article.

FIG. 2 illustrates an apparatus 20 for applying a transfer material 22 onto the surface of at least one article 10. The apparatus 20 may include a transfer component 24, an optional web control device 27, one or more deposition devices 26, an optional adhesive deposition device 28, an optional embellishment device 60, an array of cavities 38 including one or more cavities 42, an energy source 50, a loading station 44, and an unloading station 46. More specifically, the transfer component 24 may advance in a machine direction MD. The transfer component 24 may advance toward one or more deposition devices 26.

Prior to advancing the transfer component to the one or more deposition devices 26, the transfer component 24 may advance to a web control device 27. The transfer component 24 includes a cross machine direction width that is substantially perpendicular to the machine direction (MD). Based on the type of transfer material that will be applied by the one or more deposition devices, the strain in the cross machine direction width of the transfer component 24 may need to be controlled. For example, certain materials, such as inks, may cause wrinkles in the transfer component during the curing process, which occurs downstream of the material deposition process, if the strain in the web is not controlled during the material deposition process. The wrinkles in the transfer material may be visible to and unacceptable to consumers. Thus, to prevent wrinkles in the transfer material on the article, the transfer component may be strained prior to receiving the transfer material. Strain may be introduced to the cross machine direction width of the transfer component by stretching the transfer component in the cross machine direction. One or more devices may be used to introduce this strain. The amount of strain is dependent, at least in part, on the types of transfer materials and the web handling of the transfer component. For example, the transfer component may be advanced over vacuum disks that hold the edges of the transfer component. The vacuum disks are angled such that the transfer component is initially held by a portion of the vacuum disks that are separated by a first, shorter distance and as the transfer component is rotated about the vacuum disks, the distance between the vacuum disks diverges to a second, longer distance. The transfer component is stretched in the cross machine direction width as the transfer component is rotated about the vacuum disks. A vacuum conveyor may be positioned downstream of the vacuum disks to maintain the cross machine direction strain in the transfer component during the transfer material deposition process. It is to be appreciated that other devices may be used to introduce strain into the transfer component prior to the transfer component receiving the transfer material. For example, two diverging vacuum conveyors may be used to strain the transfer component or a mechanical device that introduces strain. It is to be appreciated that one or more of these devices may be used in combination with one another.

The deposition devices may be configured to deposit one or more materials onto a surface 24A, 24B of the transfer component 24. The deposition devices 26 may be configured to deposit one or more materials onto a transfer surface 24A, which is opposite the back surface 24B, of the transfer component 24. The one or more materials deposited onto the transfer surface 24A is referred to herein as the transfer material 22. The transfer material 22 may be applied to the transfer component 24 in any form suitable for being transferred from the transfer component 24 to an article 10. The transfer material 22 may be applied to the transfer component 24 such that an undecorated portion 64 is present between each deposit of transfer material 22 onto the transfer component 24. The undecorated portion 64 may be determined, in part, based on the spacing of the articles 10, the properties of the transfer component 24, such as extensibility in the machine direction MD, and the design of the transfer material 22 that is to be applied to the article 10. The transfer component 24 with at least a portion of the transfer material 22 thereon may optionally traverse to an embellishment device 60 and an adhesive deposition device 28. The embellishment device may apply any suitable material to the transfer component or material thereon, including, for example, metallic material. The embellishment device 60 may be used to add various effects to the transfer component 24, such as optical and tactile effects. The adhesive deposition device 28 may optionally deposit adhesive onto the transfer component 24. The adhesive may be needed to aid in transferring the transfer material 22 onto the transfer component 24. The materials applied by the material deposition device(s) 26, the embellishment device 60, and the adhesive deposition device 28 may together be referred to herein as the transfer material 22.

The transfer component 24 including the transfer material 22 may advance to a transfer device 48. The transfer component 24 may traverse about a portion of one or more idlers or rollers such that the one or more idlers do not adversely affect the transfer material 22 as the transfer component 24 advances to the transfer device 48. The idlers or rollers may be static, free-rotating, or driven, such as by a motor. The transfer device 48 may include an array of cavities 38. The array of cavities 38 may be in any configuration to accept one or more articles 10 and to aid in transferring the transfer material 22 from the transfer component 24. For example, the array of cavities 38 may be arranged in a linear configuration or a substantially circular configuration. As illustrated in FIG. 2, the array of cavities 38 are arranged in a circular configuration about a drum 43. The drum 43 may include a drum axis 68 about which the drum 43 rotates and an outer circumferential surface 69 extending about the axis 68. Each cavity 42 of the array of cavities 38 may be positioned about the drum axis 68. More specifically, each cavity 42 of the array of cavities 38 may be joined to at least a portion of the drum 43. The array of cavities 38 may be positioned adjacent to the outer circumferential surface 69 of the drum 43. Any number of cavities 42 may be positioned about the axis 68. The number of cavities 42 may be an even number or an odd number. The number of cavities 42 may be based, in part, on the speed of the manufacturing line, the time to transfer the transfer material to the article, and the size of the article, for example.

The transfer device 48 may be positioned adjacent a loading station 44 and an unloading station 46. The loading station 44 may be configured to supply one or more articles to the transfer device 48. More specifically, one or more articles 10 may traverse, such as by a conveying device, to the loading station 44. The loading station 44 may accept the article 10 and, subsequently, load the article 10 into a cavity 42 of the array of cavities 38. As illustrated in FIG. 2, the articles traverse and are loaded into the cavity in a direction indicated by arrow L. The loading station 44 may be configured to load each cavity 42 as the cavity traverses in front of the loading station 44, continuous loading. The loading station 44 may be configured to load every other cavity that traverses in front of the loading station 44 or some other sequence such as every third cavity or every fourth cavity that traverses in front of the loading station 44.

The loading station 44 may be a device such as a star-wheel that rotates about an axis to load articles into the cavities of the transfer device 48. The loading station 44 may be a pick and place device that uses robotics, some other mechanical device, or pneumatics to load the articles into the cavities of the transfer device 48. The loading station 44 may be programmed such that the motion of the loading of the articles may be programmed intermittently or continuously. The motion of the loading station 44 may be programmed using a programmable logic controller (PLC) with a servo control to provide matched speed when transferring the article, which allows for accurate and repeatable positioning of the article.

The unloading station 46 may be configured to remove one or more articles from the transfer device 48. More specifically, an article 10 may traverse to the unloading station 46. The unloading station 46 may accept the article 10 and, subsequently, transfer, such as by a conveying device, the article to downstream process. The unloading station 46 removes the article 10 from a cavity 42 of the array of cavities 38. As illustrated in FIG. 2, the articles 10 traverse to and are unloaded by the unloading station 46 in a direction indicated by arrow U. The unloading station 46 may be configured to unload each cavity 42 as the cavity traverses in front of the unloading station 46, continuous unloading. The unloading station 46 may be configured to unload every other cavity that traverses in front of the unloading station 46 or some other sequence such as every third cavity or every fourth cavity that traverses in front of the unloading station 46.

The unloading station 46 may be a device such as a star-wheel that rotates about an axis to unload articles from the cavities of the transfer device 48. The unloading station 46 may be a pick and place device that uses robotics, some other mechanical device, or pneumatics to unload the articles into the cavities of the transfer device 48. The unloading station 46 may be programmed such that the motion of the unloading of the articles may be programmed intermittently or continuously. The unloading of the article may be aided by one or more devices within or adjacent to the cavity. For example, a pneumatic air blow-off or mechanical ejector pin may be used to remove the article from the cavity and to the unloading station. More specifically, a mechanical ejector pin may be disposed within the cavity. The mechanical ejector pin may be compressed as the article is loaded into the cavity and held in a compressed state as the article is held within the cavity. Upon the article being released, the mechanical ejector pin may be released from its compressed position and become uncompressed causing the mechanical ejector pin to push the article from the cavity. The mechanical ejector pin may be, for example, a spring-loaded block.

As illustrated in FIG. 2, the transfer component 24 including the transfer material 22 traverses to the transfer device 48. The transfer component 24 may be positioned adjacent to the array of cavities 38 and extend about a portion of the outer circumferential surface 69 of the drum 43. The transfer component 24 may be positioned such that the transfer material 22 is positioned adjacent to the article 10 disposed in the cavity 42 such that the transfer material 22 may be transferred to a face of the article 10. As the transfer component 24 traverses about the transfer device 48, a portion of the transfer component 24 may be sealed to a portion of the cavity 42. The transfer component 24 may be sealed such that the transfer material 22 is in position to be transferred to the article 10. As the sealed transfer component 24 continues to traverse in the machine direction, the article 10 and the transfer material 22 may contact one another. Contacting the article 10 and the transfer material 22 may include modifying, such as by deforming, a portion of the transfer component 24 such that the transfer component 24 conforms to the article 10 and/or traversing, also referred to herein as moving, the article 10 in a direction toward the transfer component 24. It is to be appreciated that to contact the article 10 and the transfer component 24 any one of the following may occur: only the transfer component may be moved, such as by deformation, and the article 10 may remain stationary; the transfer component may be moved, such as by deformation, and the article may be moved; or only the article 10 may be moved into the transfer component 24.

The cavity 42 including the portion of the transfer component 24 having the transfer material 22 thereon in contact with a portion of the article 10 may traverse to an energy source 50, such as illustrated in FIG. 2. The energy source 50 may be positioned adjacent to the transfer device 48 such that the cavity traverses in front of, or adjacent to, the energy source 50. The energy source is optional, and the necessity may depend, in part, on the type of adhesive and/or material(s) used. Certain transfer materials may require an energy source 50 to cause or to aid in the transfer material 22 being transferred from the transfer component 24 to the article 10.

The energy source 50 may be used for curing any curable adhesive, ink, or varnish, which may have adhesive properties. The energy source may be located adjacent to (that is, on the same side as) the transfer surface 24A of the transfer component or adjacent to (that is, on the same side as) the back surface 24B of the transfer component. The apparatus 20 may include one or more energy sources 50. For example, an energy source 50 may be used to cure the material, such as ink or varnish, deposited on the transfer component 24 by the deposition device 26. Such curing may occur prior to any adhesive being applied by the adhesive deposition device 28. An energy source 50 may be used to cure any adhesives applied by the adhesive deposition device 28. One or more energy sources may be used to cure the applied adhesives. For example, a first energy source may be used to cure or at least partially cure the applied adhesives prior to the transfer component 24 and the transfer material 22 thereon engaging the article 10, and a second energy source may be used to cure or at least partially cure the applied adhesives and/or materials after the transfer component 24 and the transfer material 22 thereon engages the article 10. One or more energy sources may be used to cure different portions of the article. For example, two or more energy sources may be used to cure or at least partially cure the applied adhesive and/or transfer material when the transfer component engages the article. The two or more energy sources may be positioned at an angle to account for the geometry of the article.

The type of energy source will depend on the type of substance being used. The energy source may be any suitable type of device including, but not limited to: a heat source (such as a heat tunnel, or an infrared lamp); a UV lamp; an electron beam; or other energy source. If a UV-curable adhesive is used, at least sections of the transfer component 24 having the transfer material thereon, as well as the overlying layers of the transfer material may need to be transparent to UV light to allow the adhesive to be cured through the overlying layers and the transfer component 24. The curing may be initiated prior to, during, or after the transfer of the transfer material from the transfer component 24 to the surface of the article. Of course, if the adhesive is of a type (such as a pressure sensitive adhesive) that does not require curing, the energy source will not be necessary.

The transfer material 22 may be transferred from the transfer component 24 to a face, including one or more surfaces 12, of the article 10. Once the transfer material 22 has been transferred to the face of the article 10, the transfer component 24 may be removed from contacting the article 10. The face of the article 10 including the transfer material 22 may be referred to herein as a decorated portion. The transfer component 24 may traverse about an idler 25 and away from the transfer device 48. The article 10 including the decorated portion may traverse toward the unloading station 46. The article 10 including the decorated portion may be unloaded by the unloading station 46 or the article 10 including the decorated portion may traverse past the unloading station 46. The article 10 including the decorated portion that is not unloaded at the unloading station 46 may traverse past the unloading station 46 and may continue about a second revolution of the transfer device 48. During the second revolution of the transfer device 48 the decorated portion of the article 10 may receive additional decoration or a face of the article that does not include the decorated portion may be decorated on the second revolution.

The article 10 including the decorated portion may continue about the second revolution such that the decorated portion is in facing relationship with the transfer component 24 as the article traverses about the transfer device 48. Thus, additional transfer material 22 may be transferred from the transfer component to the article 10 in the area of the article including the decorated portion. The article 10 including the decorated portion may be translated and/or rotated about one or more article axis such that one or more surfaces that do not include transfer material(s) is in facing relationship with the transfer component 24. Stated another way, the article including the decorated portion may traverse linearly and/or be rotated such that the decorated portion of the article 10 is not in facing relationship with the transfer material 24 during the second revolution of the transfer device 48 and one or more surfaces 12 of the article 10 may accept transfer material 22 from the transfer component 24 to form a second decorated portion of the article 10. The second revolution of the transfer device may include the aforementioned processes and apparatuses. It is to be appreciated that the article 10 may traverse any number of revolutions about the transfer device 48. The number of revolutions of the article 10 may be determined, in part, due to the number of surfaces or faces of the article and the complexity of the predetermined pattern to be applied to the surface. Once the article 10 includes the transfer material and, thus, the desired predetermined pattern, the article 10 may be unloaded at the unloading station from the cavity of the transfer device and guided to other downstream processes.

The transfer device 48 may be integrated into a manufacturing line with one or more other processes that may occur upstream and/or downstream of the process performed by the transfer device 48. For example, the article may be manufactured, decorated with the process and device described herein, and filled at a single location. The transfer device 48 may be located at a location different from other processes that are performed on the article. For example, the article may be manufactured as a first location, filled at a second location, and decorated with the processes and device described herein at the first location, the second location, or a different third location.

It is to be appreciated that one face of the article may be decorated by a first transfer device and a second face of the article may be decorated by a second transfer device. More specifically, the first transfer device may decorate a first face of the article. The decorated article may then be transferred to a second transfer device. The second transfer device may decorate a second face of the article. It is also to be appreciated that the second transfer device may be used to apply additional decoration to the first face of the article. Any number of transfer devices may be used to apply the transfer material to the article.

The apparatus 20 illustrated in FIG. 2 is described as a top view. More specifically, the axis of rotation 68 of the drum is oriented vertically as illustrated. However, the entire apparatus 20 may be reoriented such that the axis 68 of the drum 68 is horizontal. It is to be appreciated that the apparatus 20 may also be oriented in any configuration between horizontal and vertical.

Figure 3A:
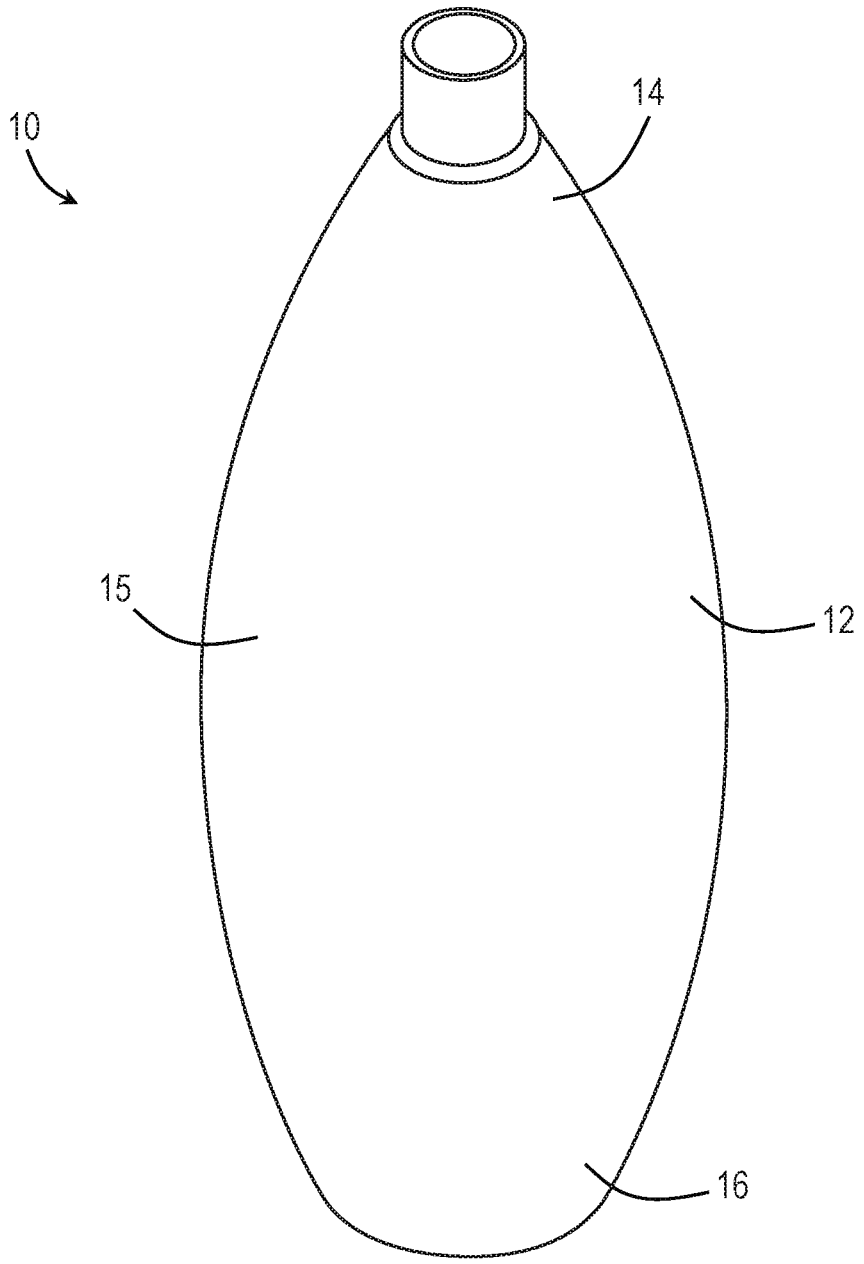
FIG. 3A is a perspective view of an article.
Figure 3B:
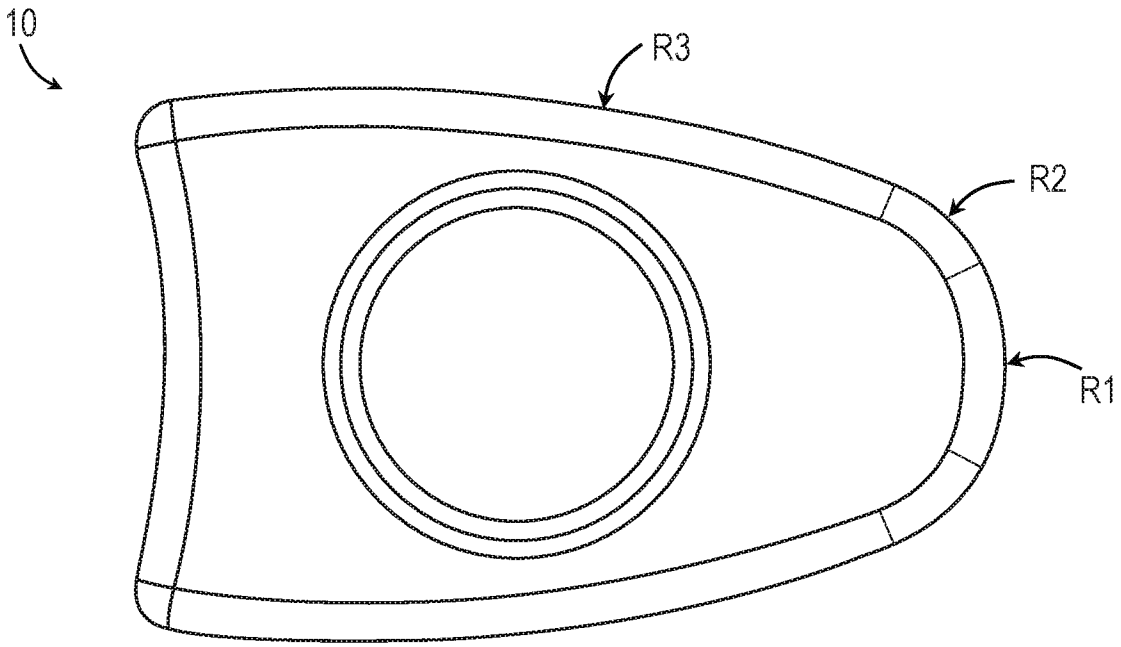
FIG. 3B is a schematic top view of an article such as a bottle.
Figure 4A:
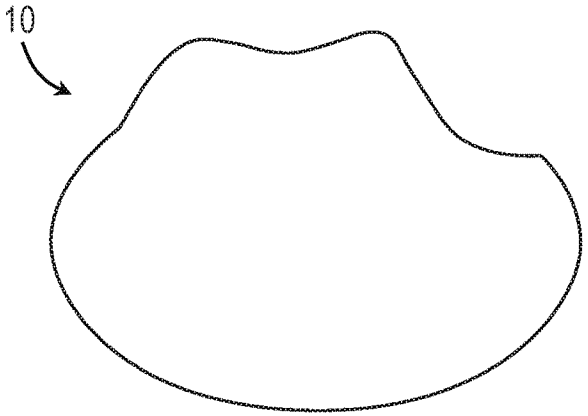
FIG. 4A is a schematic cross-sectional view of an article.
Figure 4B:
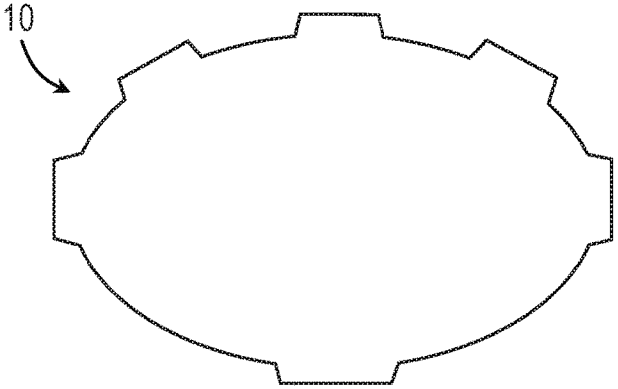
FIG. 4B is a schematic cross-sectional view of an article.
Figure 4C:
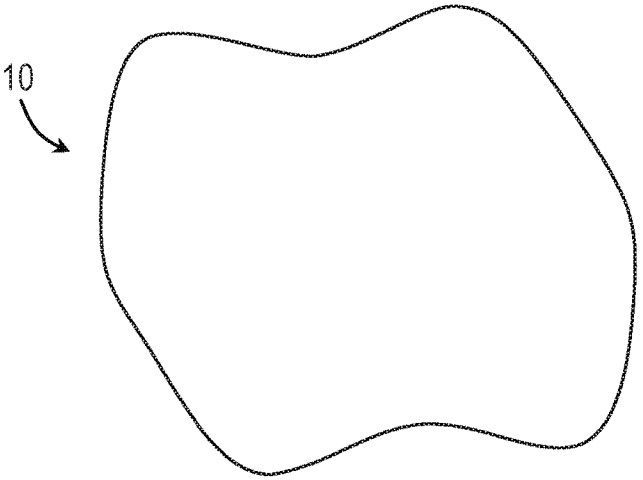
FIG. 4C is a schematic cross-sectional view of an article.
Figure 4D:
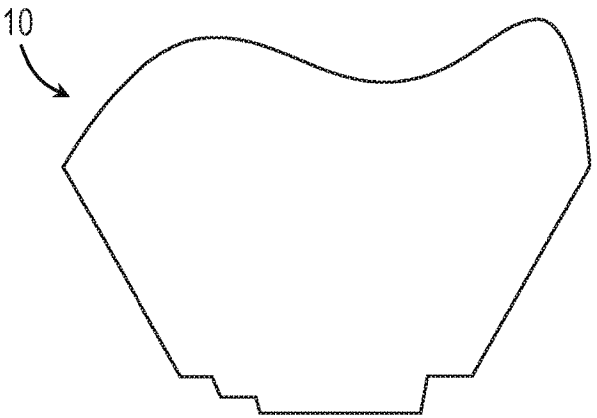
FIG. 4D is a schematic cross-sectional view of an article.

The apparatus 20 may be used to apply a transfer material 22 on numerous different types of articles 10, such as illustrated, for example, in FIGS. 3A and 3B. These articles may be three-dimensional articles and such articles may include but are not limited to: containers or packages such as bottles, boxes, cans, and cartons; laundry dosing balls; razors; components of consumer products such as razor blade heads and handles; sprayer triggers; tubs; tubes including, but not limited to tampon tubes; and deodorant stick containers. The articles may include primary packages for consumer products, including disposable consumer products. Additional articles may include components of containers or packages including, but not limited to: bottle caps, closures, and bottle pre-forms that are subsequently blown into the form of a finished bottle.

The apparatus 20 may be used to apply material to empty containers, partially filled, or filled/full containers including closed and open containers. The method and apparatus 20 may be used to apply material (e.g., decorate) to the containers, the closures, or both, separately or simultaneously. The containers may have a rigid, flexi-resilient, or flexible structure in whole or in part. In some cases in which the articles are flexible or flexi-resilient and have an interior which is empty (such as in the case of some bottles), it may be desirable to blow fluid, such as air or other gas, into the interior of the article in order to pressurize the article, above atmospheric pressure, so that the surface of the article does not yield excessively during the transfer process described herein. For example, at least a portion of the surface of the article to which a substance is to be applied may be flexible, wherein the interior of the article, which is hollow or partially hollow, is pressurized prior to transferring the material onto the surface of the article with the result that the portion of the surface of the article to which a material is to be applied is less flexible while being pressurized. Containers such as bottles may be made by any suitable method including, but not limited to blow molding. Such containers may have a threaded opening, an opening configured to accept a snap-on closure, an adhered closure, or any other suitable type of opening. The closures may be made by any suitable method including, but not limited to injection molding, blow molding, and compression molding. Such containers may be capped or uncapped with a closure when the transfer material is applied. The transfer material may be applied to the container after the container is filled and has a closure applied thereto. For example, the container may be injection molded, blow molded, or compression molded, and the container may be filled with a fluent, semi-solid, or solid material and have the closure applied thereto. In such a process, the material may be applied to the container and/or closure at the end of a manufacturing line.

The articles may be made of any suitable material, including but not limited to: plastic, metal, and/or cardboard. If the articles are made of plastic, they may be made of any suitable plastic. Suitable plastics for bottles, for example, may include, but are not limited to: polypropylene, polyethylene terephthalate (PET), high density polyethylene (HDPE), and low density polyethylene (LDPE).

The articles 10 may have at least two opposing ends. For example, a bottle may include a first end portion 14 and a second end portion 16 opposite the first end portion, such as illustrated in FIG. 3A. The first end portion 14 may include an open top, which may allow a fluid or other material to be introduced into the article, and the second end portion 16 may include a base. The articles 10 will also include one or more faces 15 and each face may include one or more surfaces 12. The one or more faces 15 may extend from the first end portion 14 to the second end portion 16 and each face 15 may have any number of surfaces 12. The articles 10 may be solid as in the case of some razor blade handles, or hollow or partially hollow in the case of bottles, for example. The one or more surfaces of the articles 10 may be flat (planar) or curved. The entire face need not be either flat or curved and may be made up of several surfaces that are flat or curved. For example, the face of the articles 10 may have: surfaces that are flat; surfaces that are curved; or, the surface may have both flat portions and curved portions. In the case of bottles, for example, at least a portion of the face may have a convex curvature. Further, some articles may have a face in which at least a portion thereof has a concave curvature.

The method and apparatus may be used to apply the transfer material 22 to uniformly cylindrical three-dimensional articles and to non-uniformly cylindrical three-dimensional articles, which include surfaces of articles that do not form part of a cylindrical object. For non-uniformly cylindrical three-dimensional articles, one or more of the surfaces may have different configurations. Such surfaces may as a result, be more complex and difficult to apply transfer materials to than cylindrical surfaces. It may be desirable to apply a transfer material to articles that have non-ruled surfaces. A non-ruled surface may be described as one that has a Gaussian curvature that is not equal to zero, such as illustrated in FIG. 3A. The article may have an exterior surface having a portion that has simultaneous radius of curvature in two or more planes wherein the absolute value of the Gaussian curvature of said surface or a portion of the surface is greater than or equal to 43 $m^{-2}$. The absolute value of the Gaussian curvature of such a surface or a portion of the surface is greater than or equal to 172 $m^{-2}$. The method and apparatus may be used to apply a transfer material onto the articles that have complex geometries. For example, the faces may include surfaces with curves that have more than one axis of curvature.

For example, the method and apparatus may be used to apply a transfer material onto two or more surfaces of an article that each have a radius of curvature. At least two of the two or more surfaces may be at least partially separated by an intermediate surface that has a lesser radius of curvature or a greater radius of curvature than at least one or the two surfaces. The intermediate surface may extend the full length of the two or more surfaces and form a boundary therebetween or, the intermediate surface may only extend a portion of the length between the two or more surfaces. The two or more surfaces may have any suitable radius of curvature. The radius of curvature of the two or more surfaces may be the same as the other such surfaces, or different. Such radii of curvature of the two or more surfaces may range from a radius that is greater than that of the intermediate surface up to an infinite radius of curvature in the case of a flat portion (or any range therebetween). For example, the two or more surfaces and the intermediate surface may all be located on one of the first end portion 14, the second end portion 16, or a face between the first end portion 14 and the second end portion 16, which may be a side of an article such as a container. The intermediate surface may be a feature on said exterior face that has a lesser radius of curvature than the two or more surfaces. The feature including the intermediate surface may protrude outward from the exterior of the article. The feature may be recessed into the exterior of the article. These features may have any suitable configurations. An example of a feature that protrudes outward from the exterior face is a ridge. An example of a feature that is recessed into the exterior face is a groove. Non-limiting examples of an article having such features are shown in FIGS. 4A-4D. FIGS. 4A-4D illustrate a cross sectional view of exemplary articles. An article may have more than one feature as described herein. An article may have more than two surfaces with an intermediate surface therebetween that have a transfer material thereon as described herein. The at least two or more surfaces may be located on different ones of the first end portion, the second end portion, and faces of the article, and the intermediate surface may include an edge between the two or more surfaces.

The apparatuses and methods described herein may, thus, be used to provide a transfer material that wraps around at least one or more surfaces and/or one or more faces of an article. For example, the transfer material may be disposed on three or more surfaces. The transfer material may be disposed on two or more faces of the article. The apparatus and methods herein may be used to provide a multi-sided application of the transfer material. The transfer material may, thus, provide a continuous image on at least portions of two or more surfaces, which may include one or more faces, of an article. The faces of an article may have an intermediate surface of the article therebetween that has a lesser radius of curvature than the other surfaces of the faces of the article, such as illustrated in FIG. 3B.

As illustrated in FIG. 3B, the intermediate surface has a radius of curvature R2 that is less than both R1 and R3. The two or more surfaces with radii R1 and R3 may have any suitable radius of curvature. Such radii of curvature may range from a radius that is greater than that of the intermediate surface up to an infinite radius of curvature in the case of a flat portion of the exterior face, or any range therebetween. It is to be appreciated that when the intermediate surface is described as having a lesser radius of curvature, the intermediate surface may have any suitable radius of curvature. The radii of curvature for the intermediate surface may range from greater than or equal to zero to less than or equal to about any of the following: 60 mm, 40 mm, 20 mm, 15 mm, 10 mm, 5 mm, 2 mm, 1 mm, or 0.1 mm, specifically reciting all 0.1 mm increments within the specified ranges and all ranges formed therein and thereby. The radius may be zero if the faces being associated with radii R1 and R3 met at a right angle that was defined by a sharp, non-rounded edge. The transfer material may be wrapped around any two or more faces or surfaces of the article. Application of the transfer material in this manner may provide the transfer material and the article with a relatively cleaner appearance without the visible edges typically seen on the front or back of articles which have heat transfer labels applied thereto.

Figure 5:
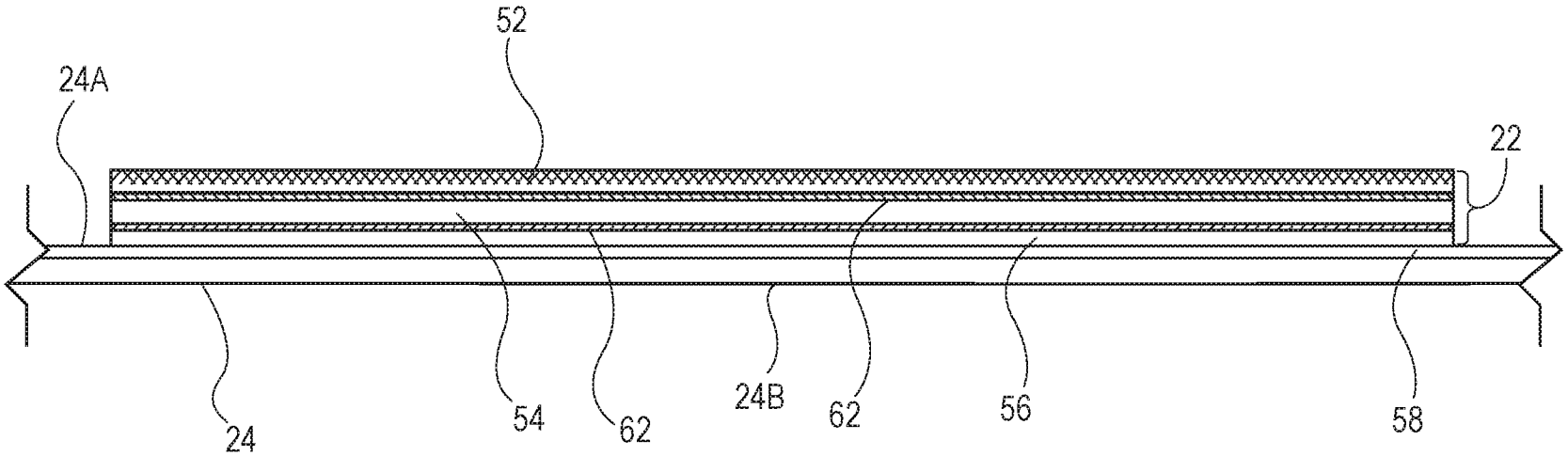
FIG. 5 is a schematic side view of a transfer component having a composite transfer material thereon.

As described herein, the transfer component 24 may be used to accept the transfer material 22 and aid in transferring the transfer material 22 to the article 10. The transfer component 24 may be any suitable component that is capable of receiving one or more materials that are deposited on the transfer component 24 to form a transfer material 22 and then transferring the transfer material 22 to at least a portion of the face of an article 10. The transfer component 24 may be one or more discrete components having the properties described herein such that each discrete component receives a transfer material for application to a single article 10. The transfer component 24 may be a continuous component. The term "continuous", as used herein, refers to a transfer component that receives two or more transfer material deposits for application to different articles. Typically, a continuous transfer component 24 will be capable of receiving a plurality of transfer material deposits for application to different articles. A continuous transfer component 24 may have a machine direction length that is greater than the dimension of the article to which the transfer material 22 is to be transferred. Continuous transfer components may be in a number of different forms. For example, a continuous transfer component 24 may be in the form of a web that is unwound from a supply roll, and after use, rewound on a take-up roll. The continuous transfer component 24 may be in the form of an endless, closed loop, belt. FIG. 5 illustrates a portion of a transfer component 24 that could be in either of these forms.

The transfer component 24 may be a single use component or a reusable component. For a single use transfer component 24, once the transfer material 22 is transferred from the transfer component 24 to an article 10, the same portion of the transfer component that contained the transfer material is not used to transfer another transfer material to another article. The transfer component 24 may be disposable after use or recycled in an environmentally compatible manner. The transfer component 24 may be reusable so that the same portion of the transfer component 24 may be used to receive and transfer more than one transfer material to different articles. When the transfer component 24 is reusable, it may be necessary and/or desirable to clean the transfer component 24 between the transfer of one transfer material 22 and the receipt of another transfer material 22 thereon. Therefore, the transfer component 24 may pass through a cleaning station after the transfer component 24 releases from the transfer material.

The transfer component 24 may have any suitable properties. It may be desirable for the transfer component 24 to be substantially incompressible under the forces associated with carrying out the method described herein. The transfer component 24 may be in the form of a web or in the form of a belt. The web or belt may have two opposing surfaces that define a thickness therebetween. These surfaces may be referred to as a front or transfer surface 24A and a back surface 24B. The web or belt may be relatively thin and/or flexible so that the web or belt may conform to the surface 12 of the article 10 without the need to compress or with minimal compression to the surface of the transfer component 24. The thickness of the transfer component 24 may change as the transfer component conforms to the surface 12 of the article 10. Both surfaces 24A and 24B of the transfer component 24 may flex in a similar manner when the transfer component 24 and the article 10 are brought into contact with each other.

A transfer component 24 in the form of a web or belt may have one or more portions that are unsupported, such as a span without any backing, between the transfer material receiving areas on the surface of the same. This characteristic of a transfer component 24 in the form of a web or belt is one of the ways such a web or belt transfer component is distinguishable from offset blankets that are mounted on cylinders.

The transfer component 24, whether discrete or continuous, may be extensible in at least one direction. For example, the transfer component 24 may be extensible in one direction and in a direction perpendicular thereto in the plane of the surfaces of the transfer component 24. A continuous transfer component 24 that moves during the process will have a machine direction MD oriented in the direction of movement and a cross-machine direction CD perpendicular to the machine direction in the plane of the surfaces of the transfer component. The continuous transfer component 24 may be extensible in the machine direction and/or the cross-machine direction. The transfer component 24 may be omni-direction extensible (extensible in all directions in the plane of the surfaces of the transfer component). It is to be appreciated that the transfer component 24 may be extensible in one direction, but due to the Poisson effect, for example, may contract in another direction, such as in a direction perpendicular to the direction in which it is extended, in the plane of the surfaces of the transfer component.

Figure 10:
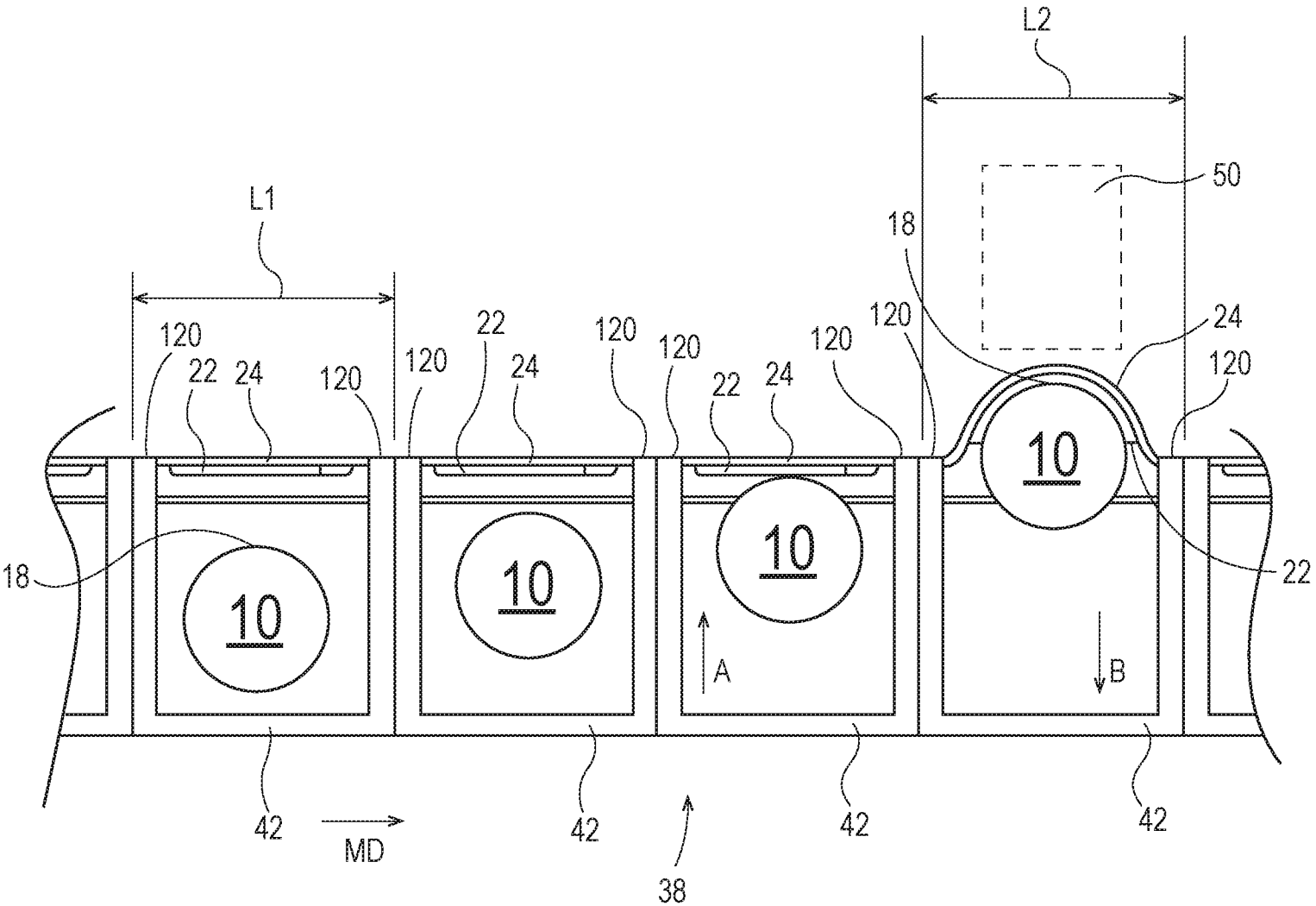
FIG. 10 is an enlarged schematic top view of an article before it is pushed into the transfer component and an article pushed into the transfer component.

The transfer component 24 may be extensible in any suitable amount under the forces associated with conforming the transfer component to the surface of the articles 10 during the process described herein. The transfer component 24 may have a first length L1, also referred to herein as an initial length, measured along its surface prior to contacting the article 10 and a second length L2 measured along its surface after contacting and conforming to the article 10, such as illustrated in FIG. 10. The first length L1 may be less than the second length L2. The extensibility of the transfer component 24 allows the change in length from the first length L1 to the second length L2. The transfer component 24, or at least the portion thereof configured to contact the surface of an article, may be extensible in amounts greater than about 0.01% up to the point of plastic deformation of the transfer component 24, or in some cases, may even approach, but not reach the point of ultimate failure of the transfer component 24. The transfer component 24 or at least the portion thereof in contact with the surface of an article may be extensible such that the transfer component 24 may increase a dimension in at least one direction by between about 0.01% to about 500%, or between about 0.01% to about 300%, specifically reciting all 0.01% increments within the specified ranges and all ranges formed therein or thereby. The transfer component 24 may be elastically extensible such that it will not only extend under force but will return back to (or toward) its original dimensions after one or more forces are removed. For example, an elastically extensible transfer component 24 is useful when portions of the transfer component 24 are deflected into a cavity.

The transfer component 24 may be made of any suitable material. The material may depend on the type of transfer component, and other desirable properties for the transfer component, such as being compressible or substantially incompressible. Suitable types of transfer components include, but are not limited to: films, belts, and discrete components. A transfer component 24 made from film may include, but not limited to, one or more of the following materials: polyethylene, polyester, polyethylene terephthalate (PET), and polypropylene. The transfer component may be made from materials that include, but are not limited to: rubber, rubberized materials, polyurethanes, and felt. At least some of such materials may be low surface energy materials having a surface energy of less than or equal to about 45 dynes/cm.

The transfer component 24 may be of any suitable thickness. If the transfer component 24 is in the form of a film, the film transfer component 24 may have a thickness within a range that is greater than about 0.0025 mm to less than or equal to about 5 mm, or less than or equal to about 3.2 mm, or less than or equal to about 2 mm, or less than or equal to about 1.5 mm, or any narrower range therebetween. A film may, for example, have a thickness in the range of from about 0.0025 mm to about 0.025 mm. It may be desirable for the transfer component 24 to have a relatively lower thickness when the article 10 has significant surface features such as high levels of localized curvature, so that the transfer component 24 is better able to conform to the configuration of the surface of the article 10. In addition, it may be desirable for the transfer component 24 to have a relatively greater thickness if it is reusable, than if it is disposable. A transfer component 24 in the form of a durable belt, for example, may have a thickness in the range of from about 0.25 mm to about 1.5 mm. The durable belt may have a thickness greater than 1.5 mm to offer some compressibility.

The transfer component 24 may have limited compressibility in a direction normal to its surfaces 24A and 24B (that is, in the direction of its thickness). For example, the transfer component 24 may compresses less than or equal to about 50%, 40%, 30%, 20%, or 10% of its uncompressed thickness under 20 psi pneumatic pressure applied normal to the surface of the transfer component 24. The transfer component 24 may also be substantially incompressible. The transfer component 24 may, for example, be substantially incompressible when it is in the form of a film. For example, a substantially incompressible transfer component 24 compresses less than or equal to about 5% of its uncompressed thickness under 20 psi pneumatic pressure applied normal to the surface of the transfer component 24. The transfer component 24 may compress less than or equal to about 1% of its uncompressed thickness under 20 psi pneumatic pressure applied normal to the surface of the transfer component 24.

The surface 24A of the transfer component 24 should be capable of receiving a deposit of a material thereon. For example, the transfer component 24 may receive a material first deposited on the transfer component 24 by printing, and the surface 24A of the transfer component may be described as a "print-receiving" surface. The surface 24A of the transfer component 24 may have an optional release coating thereon to facilitate transfer of the transfer material 22 to the article. Suitable release coatings include but are not limited to: silicone and wax. The release coating will typically be applied to the transfer component 24 before any materials are deposited on the transfer component 24. The release coating will typically remain on the transfer component 24 and will not be part of the transfer material 22 that is transferred to the article 10.

The material deposition devices, also referred to as deposition device(s), 26 may deposit any suitable material, also referred to as a substance, on the transfer component 24. The apparatus 20 may comprise any suitable number, arrangement, and type of deposition device(s) 26. For example, the apparatus may comprise between 1-20, or more, deposition device(s) 26. Thus, there may be a plurality of deposition devices 26. The deposition devices may each deposit the same materials or different materials.

The deposition device 26 may be part of the apparatus 20 and process for transferring the transfer material 22 onto the articles 10, such as illustrated in FIG. 2. Thus, the deposition device may be "in-line" with the transfer process. Alternatively, the deposition of the transfer material 22 onto the transfer component 24 may be performed using a separate apparatus and process from the process for transferring the transfer material 22 onto the surface of the article 10. For example, the material deposition portion of the process may be a separate process, such as a printing process, that is unconnected to the equipment used to transfer the transfer material 22 onto the surface of the article 10. That is, the printing of the substance may take place off-line. Thus, it is possible to deposit the transfer material 22 onto a transfer component 24 and to wind the transfer component with transfer material deposits thereon onto a roll. The roll of transfer component with transfer material deposits thereon may be brought into the process which transfers the transfer material from the roll onto the articles.

The deposition devices may either be of a type that contacts the transfer component 24 directly or by indirectly applying pressure to the transfer component 24 through the material ("contacting"), or of a type that does not contact the transfer component 24 ("non-contacting"). For the purposes of this disclosure, spraying ink on a transfer component is considered to be non-contacting. The component 25 for supporting the transfer component 24 during material deposition may include any type of component that is capable of serving such a purpose. The component 25 providing the support surface may include, but not be limited to: a cylinder, a belt, or a plate (e.g., an arcuate plate).

The deposition device 26 may be any suitable type of device including, but not limited to: offset printing systems, gravure printing systems, print heads, nozzles, and other types of material deposition devices. In the case of print heads, any suitable type of print heads may be used including, but not limited to piezo inkjet print heads, thermal inkjet print heads, electrostatic print heads and/or printing valve print heads. The print heads may be a drop-on-demand type of deposition device. By "drop-on-demand", it is meant that the print heads create droplets of ink at the nozzle only when needed such as to form a design or pattern in the form of words, figures or images (e.g., pictures). The print heads may also be "continuous" meaning drops are continuously formed at the nozzles, however only desired drops leave the print head to form the intended pattern. Ink jet print heads are typically digitally actuatable and may digitally print patterns provided by a computer. Thus, ink jet print heads are a form of a digital printing device that may digitally print material to produce the desired pattern on a portion of the transfer component 24.

Suitable materials or substances include, but are not limited to: inks (including UV-curable inks, water-based inks, and solvent-based inks), varnishes, coatings, and lotions. The material may be deposited in any suitable form. Suitable forms include, but are not limited to: liquids; colloids including gels, emulsions, foams and sols; pastes; powders; and hot melts (the latter being solids that may be heated to flow). The material may be deposited in any suitable pattern. Suitable patterns may be regular, irregular, or random, and include, but are not limited to: words (text), figures, images, designs, an indicium, a texture, a functional coating, and combinations thereof. The material 22, such as the ink(s), may be applied to the transfer component 24 in a predetermined pattern. The term "predetermined pattern", as used herein, refers to any type of pattern or design including but not limited to words, figures (e.g., pictures), images, or indicia that is determined prior to the initiation of application, which may include, for example, printing.

The apparatus 20 may include one or more adhesive deposition devices 28. The adhesive deposition device 28 is optional. If the material (such as ink or varnish) previously deposited on the transfer component 24 has sufficient adhesive properties to adhere to the surface 12 of the articles 10, a separate adhesive deposition device may not be necessary. The adhesive deposition device 28, if present, may be any suitable type of device for depositing an adhesive onto at least a portion of the previously deposited material(s) and/or the transfer component 24. Suitable adhesive deposition devices 28 include, but are not limited to: print heads, nozzles, and other types of deposition devices.

The adhesive may be any material that is suitable for adhering the transfer material 22 to the articles 10 when the transfer component 24 is brought into contact with the surface 12 of the articles 10. The adhesive enables, alone or in part, the transfer material 22 to be transferred from the transfer component 24 to the surface 12 of the articles 10. For example, some adhesives may need to be activated to enable transfer to the article. Suitable adhesives include, but are not limited to: pressure sensitive adhesives, UV or Electron Beam curable adhesives, water-based adhesives, solvent-based adhesives, heat setting (or thermally activated) adhesives, and two-part or multi-part adhesives (for example two-part epoxy adhesives). The adhesive may be of a non-heat activated (or thermally-activated) type, such as in the case of heat transfer labels. The adhesive may be formulated so that the adhesive composition will cure sufficiently to provide the transfer within the allotted process time. For example, the allotted process time may be from about 0.1 second to about 10 seconds range. In the case of two-part epoxy adhesives, the first part may be applied by one deposition device and the second part may be applied by a second deposition device. An adhesive system may also be applied such that, a first part of the adhesive may be applied to the transfer component 24 and a second part of the adhesive may be applied to a portion of the article 10. With any of the adhesive systems, it may be desirable to at least partially cure the adhesives prior to contacting the article in order to control squeeze out/flow of the adhesive.

The adhesive may have a sufficiently low tack, a first level of tackiness, during the initial stage of contacting the article 10 with the transfer component 24 or contacting the transfer component with the article so that at least portions of the transfer material 22 may slip along the surface 12 of the article 10 in order to conform to the surface of the article without damage to the transfer material 22 or the transfer component 24. If the adhesive is a type that may be cured, at this initial stage, the adhesive may be uncured, or only partially cured. Once the transfer component 24 with the transfer material 22 thereon is conformed to the surface of the article 10, pressure may be applied to the transfer component in a direction substantially normal to the surface of the article in order to conform and/or adhere the transfer material 22 to the surface of the article 10. It may be desirable for the ink component to be fully cured before normal pressure is exerted on the transfer component so that the ink will not undesirably spread, distorting any image, etc. and/or causing the ink to ooze out of the transfer material.

The apparatus 20 may include an embellishment device 60. The embellishment device is a device that may be used to add a visual, tactile, or olfactory effect by means of material deposition that is applied directly, or transferred, such as by transferring from the transfer component, to an article 10 or by transforming a property of an article, or combinations thereof. An example of transforming a property of an article without transferring a material to the surface of the article is imparting an image on the surface of an article by a laser. A single embellishment device may be used to apply a single decorative effect or multiple decorative effects. Alternatively, multiple embellishment devices may be used to apply the decorative effect(s). The material deposited by the embellishment device may occur before or after the deposition of material by the material deposition device on the transfer component 24, or even directly onto the articles before or after the transfer material 22 is applied to the articles 10.

The embellishment device may deposit a metallic substance on the transfer component 24 and/or onto one of the substances already disposed on the transfer component. For example, the metallic substance may be deposited indirectly on the transfer component 24. A metallic substance may be used to provide the article 10 with a metallic effect. The metallic material may include any suitable type of metallic material including, but not limited to: a metallic foil; printed metallic ink; or sintered metal. If the metallic material includes a metallic ink, it may be printed by any of the processes described herein for printing the ink component. A metallic substance may be deposited on the transfer component 24 such as described in U.S. Patent Application No. 62/664,967 filed May 1, 2018 and U.S. patent application Ser. No. 15/992,265 filed May 30, 2018.

The embellishment device may add a tactile effect to the transfer material 22 and, thus, to the article 10. The tactile effect may include a buildup texture that is transferred to the surface 12 of the article 10. The texture may be created by depositing a textured substance on the transfer component 24 before, during or after depositing other substances on the transfer component 24. Alternatively, the tactile effect may be created by using a textured transfer component 24.

It is to be appreciated that the material deposition device, the adhesive deposition device, and the embellishment device may each apply different materials and be substantially the same type of equipment. For example, each of the material deposition device, the adhesive deposition device, and the embellishment device may include one or more nozzles used to deposit material onto the transfer device.

FIG. 5 illustrates one example of a transfer material 22 on a portion of a transfer component 24. The components of the transfer material 22 may include: an optional adhesive (or varnish with adhesive properties) 52; an ink component, which may be in the form of artwork, an image, etc. 54; and, an optional protective coating or component (such as a clear varnish) 56. An optional additive or release agent 58 may also be applied to the transfer component 24. The transfer component 24 is in the form of a relatively thin film or belt. In addition to the components discussed herein and illustrated, other optional components may be included in the transfer materials 22. For example, the ink component 54 may be formed by depositing CMYK, and an optional base layer, which may be white or any suitable color, may be provided between the optional adhesive 52 and the ink component 54. In addition, an optional metallic material 62 may be provided between the optional adhesive 52 and the ink component 54, or between the ink component 54 and the optional protective component 56. It should be understood, however, that one or more of these optional layers may be omitted, and that in its simplest form the transfer material 22 may only consist of an ink component (such as a varnish or an ink layer) 54 if the ink component 54 has sufficient adhesive properties to adhere to the surface 12 of the article 10, and if the ink component has sufficient protective properties and wear resistance that it does not require a protective component. The transfer material 22 will typically be free of any release paper, such as that used to cover adhesive on decals. The transfer material 22 may be free of a carrier that remains on the article after the transfer material is applied to the surface of an article, such as in the case of heat transfer labels.

It is to be appreciated that all of the components illustrated in FIG. 5 may, but need not have, the same dimensions and/or plan view configurations. Any of these components may have greater or lesser dimensions in any direction than any of the other components. However, it may be desirable for the optional adhesive component 52 (or ink layer with adhesive properties) to have dimensions that are equal to or greater than the underlying layers as arranged on the transfer component 24, which may become overlying layers on the surface of the article, so that the underlying layers will be adhered to the surface 12 of the article 10.

The process herein may be described in terms of depositing one or more of the materials described above on the transfer component 24. It should be appreciated, however, that it is not necessary that a particular material be deposited directly on the surface 24A of the transfer component 24. The depositing of the material on the transfer component 24 may include depositing the material directly on the surface 24A of the transfer component 24, or indirectly depositing a material on the surface 24A of the transfer component 24, such as by depositing one material (for example an adhesive) on top of another material (for example an ink) that is already on the surface 24A of the transfer component 24.

Although the components of the transfer material 22 are shown as layers in FIG. 5, one or more of these components may, but need not be in the form of a layer. For example, in the ink component 54, some ink droplets may stay discrete; some others may merge together to form a film-like structure. The components of the transfer material 22, if deposited in a form which may need to be cured, may also be in various states ranging from non-cured to fully cured. It may be desirable for the ink to be in the form of a pre-formed image before the transfer of the transfer material 22; otherwise, the desired pattern of ink (e.g., the image) may degrade during transfer. As used herein, the term "pre-formed" image refers to a dried image in the case of solvent or water-based inks, or a fully cured or partially cured image in the case of curable inks. The ink may therefore be pre-formed and the adhesive may be non-cured, or only partially cured. A transfer of a pre-formed ink image by the transfer material differs from ink jet printing directly on an article wherein the droplets of ink are deposited on an article and then dried or cured.

The release agent 58 may be used to ensure that the transfer material 22 releases cleanly from the transfer component 24 and transfer to the surface 12 of the articles 10. The release agent 58 may be continuous in the machine direction as shown in FIG. 5, or it may be in the form of discrete patches that only underlie the transfer material 22.

The transfer device 48 may be any suitable type of device for traversing the article(s) 10 so that the articles 10 may contact, or be contacted by, the transfer component 24 and have the transfer material 22 transferred to the articles 10. The term "transfer device", as used herein, refers to devices that move articles generally, and is not limited to drums. Suitable transfer devices may include, but are not limited to: turret, star wheel, endless loop conveyors, and linear conveyors which may be in the form of tracks, belts, chains, and the like, puck conveyors, and tracks with independently controllable magnetic pucks.

Figure 6:
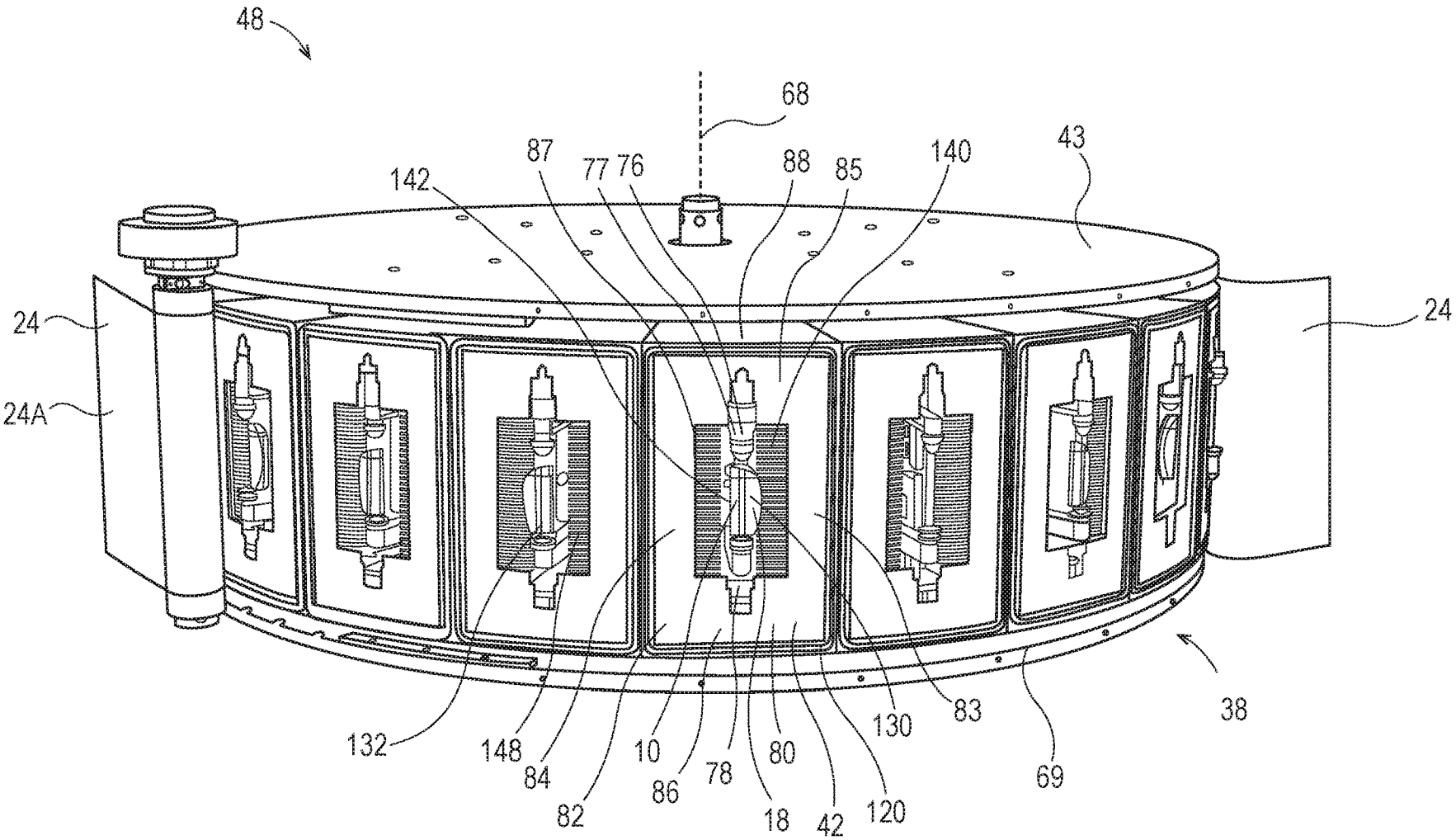
FIG. 6 is a schematic perspective view of a transfer device include an array of cavities.

As illustrated in FIGS. 2 and 6, the transfer device 48 may include a drum 43 and any suitable type of holder for holding the articles 10 thereon. As illustrated in FIG. 6, the transfer device 48 may include a drum 43 with an array of cavities 38 joined thereto. Each of the array of cavities 38 may be configured to hold and manipulate an article 10. The term "joined to" as used throughout this disclosure, encompasses configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The drum 43 may be configured to rotate about an axis 68. The drum 43 may rotate at a constant velocity, or the velocity of rotation may be varied, if desired. The rotation of the drum 43 may be continuous, or if desired, intermittent. The rotation of the drum 43 results in the cavities 42 joined thereto also rotating about the axis 68. There may be any number of cavities joined to the transfer device 48. There may be an even number of cavities or an odd number of cavities. The cavities may be positioned such that a first cavity of the array of cavities and a second cavity of the array of cavities abut. The cavities may be positioned such that a first cavity of the array of cavities and the second cavity of the array of cavities are positioned adjacent to one another. It is also to be appreciated that the cavities may have a constantly changing positional relationship with one another, such as with cavities that are disposed on a transfer device including individual programmable pucks. The cavities 42 may be configured to hold articles having a variety of configurations, or they may be configured to more precisely correspond to the shape of the portion of the articles 10 that faces away from the transfer component 24.

Referring to FIGS. 6 and 7A-7C, each cavity 42 of the array of cavities 38 may be configured to receive, position, hold, traverse, and release the article 10. Each cavity 42 in the array of cavities 38 may include a frame 80. At least a portion of the frame 80 may be joined to the transfer device 48. The frame 80 may include a front face 82 and a back face 81 opposite the front face 82. The front face 82 may include a first side portion 83 and a second side portion 84, which may be opposite the first side portion 83. The front face 82 may also include an upper portion 85 and a lower portion 86 that may be opposite to the upper portion 85. The first side portion 83, the second side portion 84, the upper portion 85 and the lower portion 86 define an opening 87. It is to be appreciated that the front face 82 of the frame 80 may be a single unitary element or two or more elements joined to form the front face 82. The surface of the front face 82 of the frame 80 may be curved such that the array of cavities generally is in the form of a circle. The surface of the front face 82 may be substantially planar or any other shape that allows the array of cavities to traverse in a generally continuous process and/or allows the transfer material to be sealed thereto.

The front face 82 may include a sealing portion 120. The sealing portion 120 may be any feature that is added to the front face to aid in controlling the position and movement of the transfer component. As discussed, the transfer component 24 may traverse about the transfer device 48 such that a portion of the array of cavities are positioned in facing relationship with a transfer surface 24A of the transfer component 24. More specifically, the front face 82 of each of the cavities 42 is in facing relationship with the transfer surface 24A, which includes the transfer material 22, of the transfer component 24. To transfer the transfer material 22 to the article 10, the portion of the transfer component 24 including the transfer material 22 is positioned within the opening 87 of the cavity 42. The position of the transfer material 22 within the opening 87 should be such that the transfer material 22 is transferred to the desired portion of the article 10. The alignment of the transfer material 22 with respect to the article 10 may be controlled by maintaining the tension and strain in the transfer component as the transfer component traverses to the cavity, or, in addition to, controlling the transfer component, a registration system may be used. The registration system may be, for example, a vision system that identifies and tracks a feature of the transfer component, such as a registration mark or the transfer material. The registration system identifies the position of the transfer component and may appropriately modify the transfer component, such as by increasing the speed or decreasing the speed of the transfer component, to ensure that the transfer component is positioned to transfer the transfer material to the desired portion of the article. To align the transfer material with the article such that the transfer material is transferred to the desired portion of the article, the position of the article within the cavity may also be adjusted. The movement of the article may be based on feedback from a registration system, such as a vision system. Further, to obtain alignment of the transfer material with the article, the speed at which the cavity traverses may also be changed.

To obtain and maintain the position of the transfer material 22 with respect to the article 10, a portion of the transfer component 24 engages and is sealed to at least a portion of the first face 82 of the cavity 42. Sealing a portion of the transfer component 24 to at least a portion of the first face 82 of the cavity 42, isolates that portion of the transfer component 24 from downstream and upstream areas of the transfer component, and, thus, does not adversely affect the intended downstream and/or upstream use of the transfer component.

As illustrated in FIGS. 6 and 7A-7C, the sealing portion 120 may include one or more grooves 122 fluidly connected to a vacuum source. The one or more grooves 122 engage and seal a portion of the transfer component 24 to at least a portion of the front face 82 of the cavity 42. The one or more grooves 122 may extend about the entire perimeter of the front face 82 or a portion thereof. The grooves may be positioned on any portion of the front face 82 such that a seal of the transfer component may be formed. Any other shape of sealing portion that allows for control of the transfer component may also be used. The sealing portion 120 may include one or more magnets, a static electricity device, an adhesive, or other mechanical device, such as clamps, to control and seal the transfer component to the cavity. Further, the front face 82 may include a surface feature to aid in controlling the transfer component. For example, the front face 82 may include a surface feature, such as texture or a coating, to increase the surface friction, to aid in controlling, such as by maintaining the position of, the transfer component 24.

The frame 80 may include a frame body 88. At least a portion of the frame body 88 may be joined to the transfer device 48. The frame body 88 may extend from the back face 81 and define a chamber 89 therein. The chamber 89 defined, at least in part, by the frame body 88 may be accessed through the opening 87 in the front face 82 of the frame 80. The frame body 88 may be any shape such that the cavity may receive, hold, and position the article. For example, the frame body 88 may include a first frame surface 124 opposite the opening 87, and a second frame surface 126 and a third frame surface 128 that join the first frame surface 124 and the back face 82.

Each cavity 42 of the array of cavities 38 may include a clamp 76. The clamp 76 may be disposed within each cavity 42. The clamp 76 may be used to receive, release, and hold the article 10 as the article traverses in the machine direction about the transfer device 48. The clamp 76 may operatively engage any portion of the article 10 to receive and hold the article 10. The clamp 76 may hold the article 10 in a stationary position relative to the cavity. The clamp 76 may be powered by a power source that is internal to the cavity or external to the cavity. For example, to power the clamp to open to accept or release the article or close to hold the article, the clamp may include an externally accessible cam follower that is configured to engage an external cam slot positioned adjacent to the turret. Engagement of the cam follower with the slot may cause the clamp 76 to open or close and hold the article.

Further, the clamp 76 may be used to position the article 10. The clamp 76 may cause at least one of linear movement or rotational movement of the article. More specifically, the clamp 76 may be used to align the article about an axis of the article that positions the article in a desired orientation within the cavity. It is to be appreciated that the article 10 may or may not be symmetrical about the article axis. The clamp 76 may also be used to rotate the article 10. The clamp 76 may rotate about at least one of a first clamp axis 79A and a second clamp axis 79B to cause rotation of the article 10. It is to be appreciated that the clamp axis 79A, 79B may or may not be aligned with the article axis. The clamp 76 may be powered by a power source that is internal to the cavity or external to the cavity. For example, to power the clamp to rotate the article, the clamp may include an externally accessible cam slot that is configured to engage an external actuating finger positioned adjacent to the turret. Engagement of the external finger with the slot may cause rotations of the article.

The clamp 76 may be mechanical clamp or the clamp may be pneumatically controlled, electrostatically controlled, or some other similar mechanism that allows the article to be accepted by, held in position by, and released from the cavity.

As illustrated in FIGS. 6 and 7A-7C, for example, the clamp 76 may cause rotation of the article 10 about the first clamp axis 79A. The article 10 may be positioned in a first position such that a first face 130 is visible through the opening 87 of the cavity 42 and a second face 132 is not visible through the opening 87 of the cavity 42. Stated another way, the article 10 may be positioned in an first position within the cavity such that a first face 130 of the article is positioned to be in facing relationship with the transfer component and the second face 132 of the article is positioned in facing relationship with at least one of the first frame surface 124, the second frame surface 126, and the third frame surface 128. Generally, the article may be positioned in a first position within the cavity such that a first face 130 of the article is positioned in a direction away from the chamber 89 as indicated by arrow A and the second face 132 of the article is positioned in a direction toward the chamber 89 as indicated by arrow B.

The article 10 may be rotated from a first position to a second position about an article axis. The direction of rotation may be clockwise and/or counterclockwise. The article 10 may be positioned in the second position such that the second face 132 is visible through the opening 87 of the cavity 42 and a first face 130 is not visible through the opening 87 of the cavity 42. Stated another way, the article 10 may be positioned in the second position within the cavity such that a second face 132 of the article is positioned to be in facing relationship with the transfer component and the first face 130 of the article is positioned in facing relationship with at least one of the first frame surface 124, the second frame surface 126, and the third frame surface 128. Generally, the article may be positioned in a second position within the cavity such that the second face 132 of the article is positioned in a direction away from the chamber 89 as indicated by arrow A and the first face 130 of the article is positioned in a direction toward the chamber 89 as indicated by arrow B. It is to be appreciated that the article 10 may be rotated in any manner to change the face of the article that is in facing relationship with the transfer component. For example, the article may be rotated end-over-end. The article may be rotated about any axis. The axis of rotation may be the axis that most efficiently positions the face of the article to be decorated in facing relationship with the transfer component.

The clamp 76 may be used to rotate the article 10 from 0 degrees to 360 degrees about the first clamp axis 79A and the second clamp axis 79B. Any face of the article 10 that is visible through the opening and in facing relationship with the transfer component is the face of the article to which the transfer material is to be transferred may be referred to herein as the target face of the article. The target face may include one or more surfaces of the article 10 to which the transfer material 22 is to be applied.

The clamp 76 may be configured to move in a direction substantially parallel to the front face 82 of the cavity 42. The movement of the clamp 76 may provide a gap into which the article 10 may be received. Further, the movement of the clamp 76 may again provide a gap that allows the article 10 to be removed from the cavity 42. The clamp 76 may be configured to traverse from a first clamp configuration, which provides a gap, and a second clamp configuration, which provides operative engagement between the clamp 76 and a portion of the article 10. The clamp 76 may be configured to operatively engage any portion of the article 10 such that the article 10 is held in position and the transfer material may be transferred to the article 10.

The clamp 76 may be configured to move the article 10 in a direction substantially parallel to the article axis 11. Stated another way, the clamp 76 may be configured to move the article 10 the article 10 in a direction substantially parallel to the transfer surface 24A of the transfer component 24. Movement of the article 10 in a direction parallel to the transfer surface of the transfer component may aid in positioning the article such that the transfer material is transferred onto the desired area of the article 10.

The clamp 76 may be configured to move in a direction substantially perpendicular to the transfer surface 24A of the transfer component 24. Stated another way, the clamp 76 may be configured to move through the opening 87 of the cavity 42. Thus, the clamp 76 may move the article 10 through the opening 87 of the cavity 42. The clamp 76, with or without operatively engaging the article, may move from a third clamp configuration such that the clamp 76 is disposed within the chamber 89 of the cavity 42 to a fourth configuration such that at least a portion of the clamp 76 may be positioned outside the chamber 89 of the cavity 42. In traversing from the third configuration to the fourth configuration, a portion of the clamp 76 may pass through the opening 87 of the cavity 42. For example, the clamp 76 may be positioned in the third clamp configuration while engaging the article 10 such that the transfer component may not engage the article as the transfer component is sealed to a portion of the cavity. The clamp 76 may then traverse from the third clamp configuration to a fourth clamp configuration such that the transfer component may operatively engage the article.

A portion of the clamp 76 may operatively engage one or more tracks 106 along which the clamp 76 may traverse. One or more tracks may be used to traverse the clamp 76 from the first clamp configuration to the second clamp configuration. Similarly, one or more tracks by be used to traverse the clamp 76 from the third clamp configuration to the fourth clamp configuration. The one or more tracks 106 may include linear bearings, for example. The one or more tracks 106 may be joined to the cavity 42. The one or more tracks may be horizontally positioned, vertically positioned, or positioned at some angle within the cavity 42 to allow for traversal of the clamp.

It is to be appreciated that the clamp 76 may be configured to traverse the article linearly and not rotationally or both linearly and rotationally. For example, the article 10 may be traversed linearly by the clamp 76 and the article may be transferred to an external process to be rotated and subsequently loaded back into the cavity.

The clamp 76 may include a conduit that is configured to introduce a fluid, such as air, into the interior of the article 10. A portion of the clamp 76 may engage an open end portion of the article such that the conduit is in fluid communication with the interior of the article 10. The fluid introduced into the article may stabilize the article during the transfer of the transfer material. For example, the fluid may prevent collapse of the face of the article during transfer of the transfer material thereto.

Figure 7C:
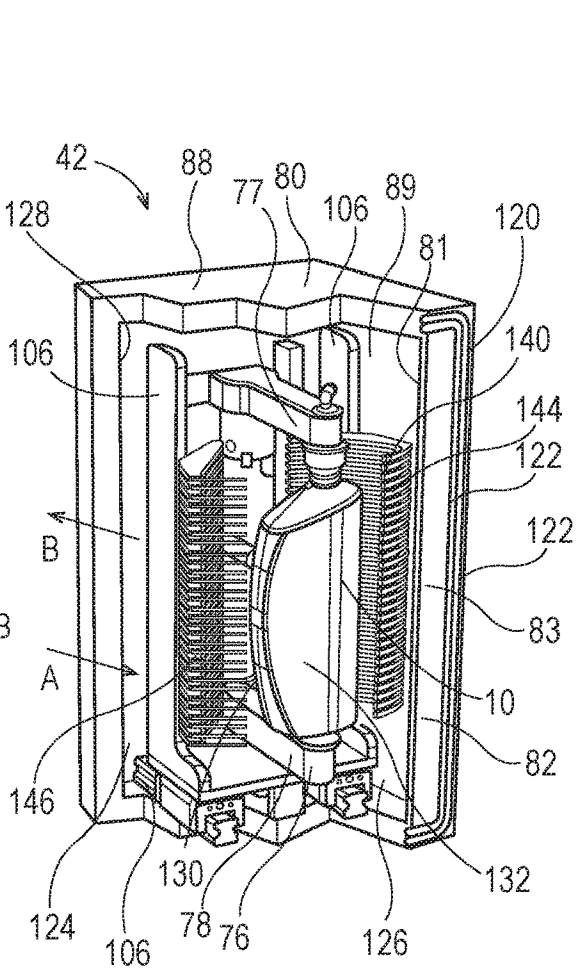
FIG. 7C is a perspective, partially cut-away view of a cavity.
Figure 7B:
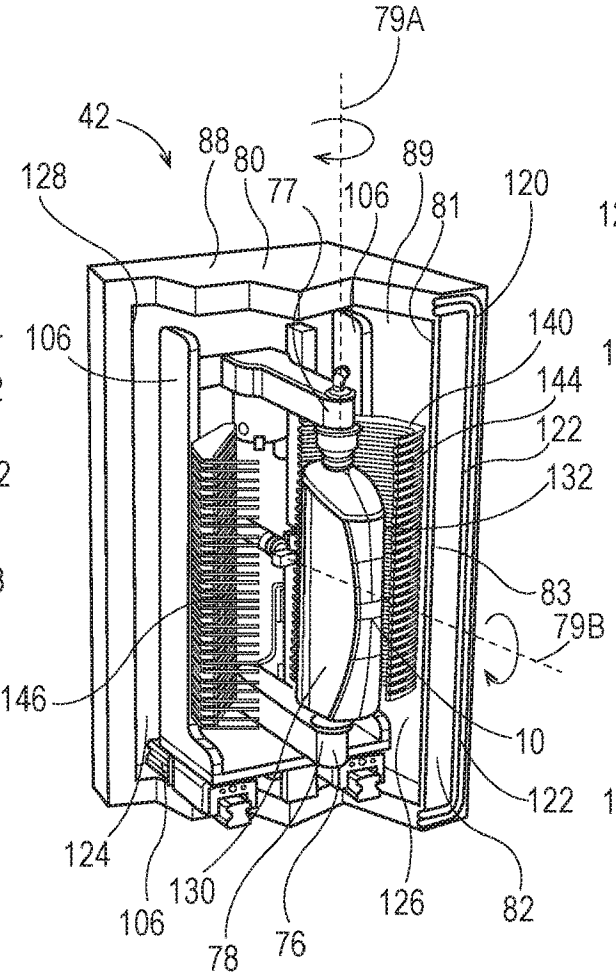
FIG. 7B is a perspective, partially cut-away view of a cavity.
Figure 7A:
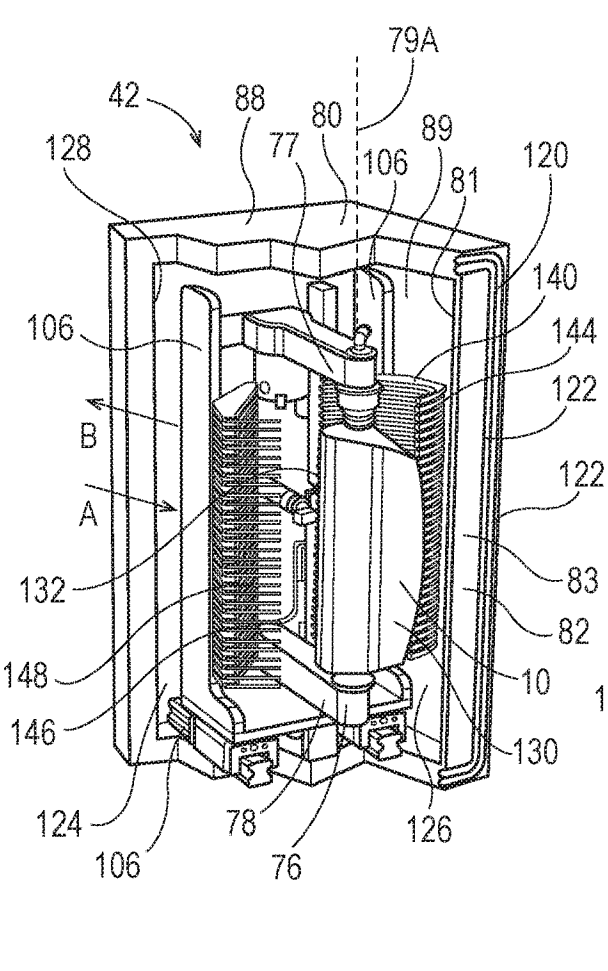
FIG. 7A is a perspective, partially cut-away view of a cavity.

The clamp 76 may include a first clamp portion 77 and a second clamp portion 78. The first clamp portion 77 may operatively engage a first portion of the article 10 and the second clamp portion 78 may operatively engage a second portion of the article 10. For example, as illustrated in FIGS. 6 and 7A-7B, the first clamp portion 77 may engage a first end portion of the article, such as the neck of a bottle, and the second clamp portion may engage a second end portion of the article, such as the base of a bottle. At least one of the first clamp portion 77 and the second clamp portion 78 may be configured to move. The first clamp portion 77 and/or the second clamp portion 78 may be configured to move in a direction substantially parallel to the front face 82 of the cavity 42. The movement of at least one of the first clamp portion 77 and the second clamp portion 78 may provide a gap into which the article 10 may be received. Further, the movement may again provide a gap that allows the article 10 to be removed from the cavity 42. At least one of the first clamp portion 77 and the second clamp portion 78 may be configured to traverse from a first clamp configuration, which provides a gap for loading and unloading, and a second clamp configuration, which provides operative engagement between the clamp portions 77, 78 and a portion of the article 10. The first clamp portion 77 and the second clamp portion 78 may be configured to operatively engage any portion of the article 10 such that the article 10 is held in position and the transfer material may be transferred to the article 10.

It is to be appreciated that any number of clamps may be used to receive, hold, position, and release the article from the transfer device 48. The one or more clamps may engage any portion of the article such that the article is received, held, positioned, and removed from the transfer device 48.

Each cavity 42 of the array of cavities 38 may include a support member 140. The support member 140 may be disposed within the opening 87 of the cavity 42. The support member 140 may be positioned within the chamber 89 of the cavity 42. The support member 140 may extend from the upper portion 85 of the front face 82 to the lower portion 86 of the front face. The support member 140 may be positioned adjacent to the clamp 76. The support member 140 may provide a support surface that extends from the opening 87 toward the article 10. The support member 140 may engage at least a portion of the article 10. For example, the support member 140 may engage the portion of the article 10 adjacent to the target surface of the article 10. The support member 140 may also engage the portion of the article 10 positioned in facing relationship with the chamber 89 of the cavity 42. The support member 140 provides support to the transfer component 24 as a portion of the transfer component 24 is being conformed to the face of the article 10. The support member 140 may also aid in alignment and positioning of the article based on how the article fits with respect to the support member 140. Thus, the support member 140 may aid in reducing the variation and increasing the accuracy of the placement of the transfer material on the article. The transfer component 24 made be made from a material that fails if stretched beyond a certain point. The support member 140 allows the transfer component 24 to be conformed to the article face while preventing the transfer component 24 from, for example, breaking. The support member 140 may be stationary or moveable.

It is to be appreciated that the support member 140 may not need to engage the article 10 to provide support to the transfer component 24. A support gap 142 may be present between the article 10 and the support member 140. The maximum width of the support gap 142 may be determined, in part, due to the properties of the transfer component, such as flexibility and strength of the material, the shape of the article 10, and the forces exerted on the transfer component, such as a vacuum force or mechanical form to conform the transfer component to the article. For example, a relatively smaller support gap may be needed for a transfer component that is relatively thin, weak, and inflexible. A relatively larger support gap may be needed for a transfer component that is relatively think, strong, and flexible. It is also to be appreciated that portions of the support member 140 may engage the article while other portions of the support member 140 may form a support gap 142 between the article.

The support member 140 may include a first support member portion 144 and a second support member portion 146. The first support member portion 144 may be positioned within the opening 87 and adjacent to the first side portion 83 of the front face 82. The second support member 146 may be positioned within the opening 87 and adjacent to the second side portion 84 of the front face 82. The support member 140 may be configured to move from a first support configuration to a second support configuration. The support member 140 may move, such as by rotation or linear movement, to a first support configuration such that the article 10 may be loaded into and/or unloaded from the cavity 42. The support member 140 may move, such as by rotation or linear movement, to a second support configuration such that the article 10 may be substantially surrounded by or engaged by the support member 140 and the support member 140 is in a configuration to provide support to the transfer component during the transfer of the transfer material to the target surface of the article. The support member 140 may also be configured to move from a third support configuration to a fourth support configuration. The support member 140 may move from a third support configuration such that the support member 140 is disposed within the chamber 89 of the cavity 42 to a fourth configuration such that the support member 140 or a portion of the support member 140 moves through the opening 87 of the cavity 42 and is positioned external to the cavity.

Each support member portion may be a single unitary element or may be made up of two or more elements. For example, the support member 140 illustrated in FIGS. 6 and 7A-7C includes a plurality of support fingers 148. The plurality of support fingers 148 may each move independently of one another such that as the support fingers engage the article, the support edge profile of the support member becomes the shape of the portion of the article to which the support fingers are engaged. A portion of the support fingers provide a substantially flat planar surface onto which the transfer component may be supported from the first face to the face of the article. The plurality of support fingers may rotate about a support finger axis. The plurality of support fingers may rotate in a clockwise and counterclockwise direction to allow for loading and unloading of the article. The support fingers may rotate to a first support configuration such that a loading gap is formed to allow the article to be loaded and unloaded from the cavity. The support fingers may rotate to a second support configuration such that the support fingers engage a portion of the article and provide support to the transfer component during transfer of the transfer material to the target surface of the article.

Figure 8B:
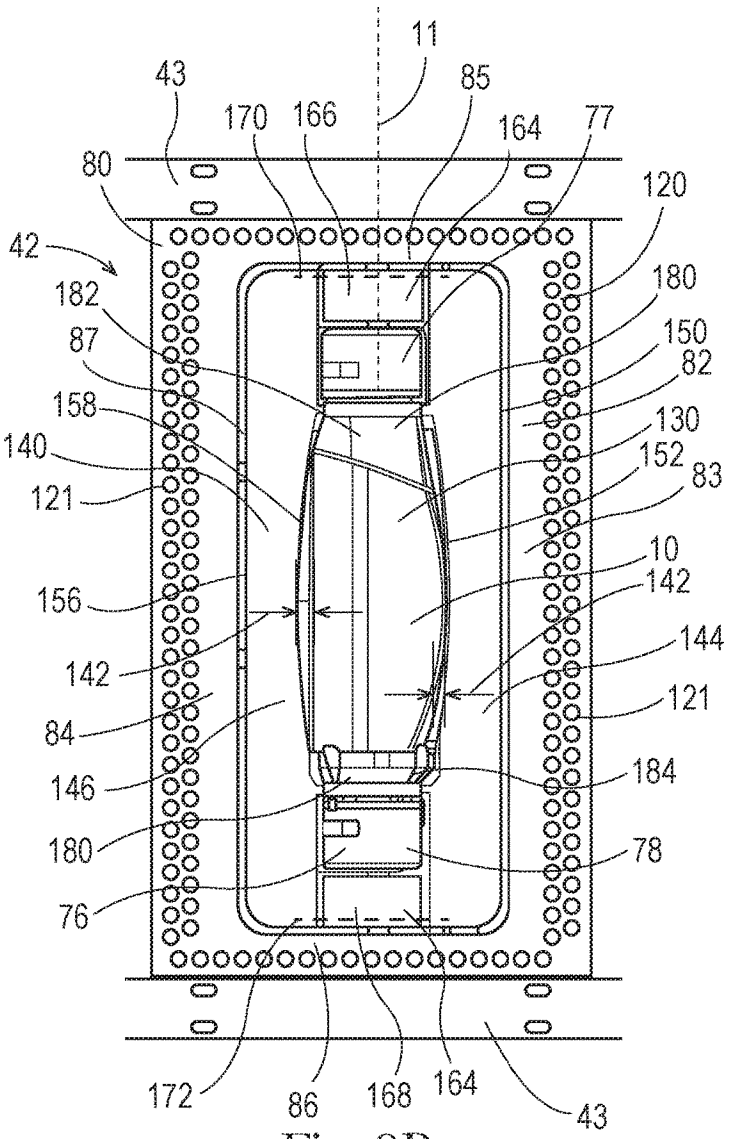
FIG. 8B is a front view of a cavity including an article.
Figure 8A:
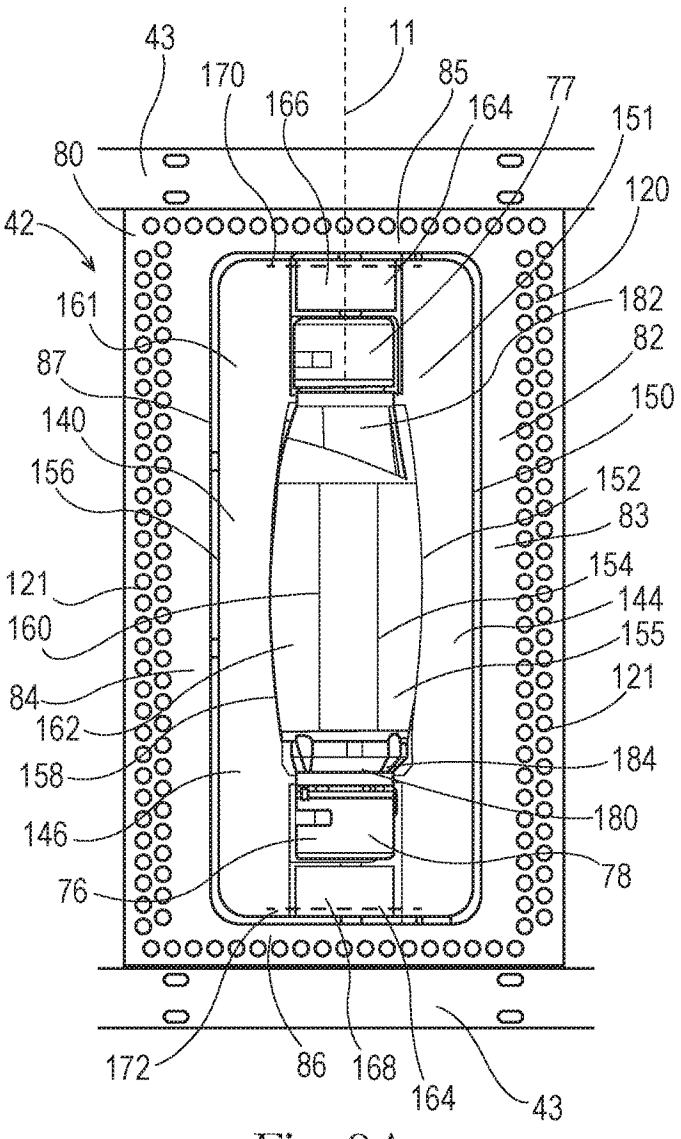
FIG. 8A is a front view of a cavity.

FIGS. 8A and 8B illustrate a cavity 42 which generally includes those features as previously discussed and are similarly labeled. The cavity 42 may include a front face 82. The front face 82 may include a sealing portion 120. The sealing portion 120 may be any feature that is added to the front face to aid in controlling the position and movement of the transfer component. As discussed, to transfer the transfer material 22 to the article 10, the portion of the transfer component 24 including the transfer material 22 is positioned within the opening 87 of the cavity 42. The position of the transfer material 22 within the opening 87 should be such that the transfer material 22 is transferred to the target face of the article 10. To obtain and maintain the position of the transfer material 22 with respect to the article 10. A portion of the transfer component 24 may engage and be sealed to at least a portion of the first face 82 of the cavity 42. Sealing a portion of the transfer component 24 to at least a portion of the first face 82 of the cavity 42, isolates that portion of the transfer component 24 from downstream and upstream areas of the transfer component, and, thus, does not adversely affect the intended downstream and/or upstream use of the transfer component. As illustrated in FIGS. 8A and 8B, the sealing portion 120 may include one or more apertures 121 fluidly connected to a vacuum source. The one or more apertures 121 engage and seal a portion of the transfer component 24 to at least a portion of the front face 82 of the cavity 42. The one or more apertures 121 may extend about the entire perimeter of the front face 82 or a portion thereof. The apertures may be positioned on any portion of the front face 82 such that a seal of the transfer component may be formed.

It is to be appreciated that the transfer component 24 may be sealed or at least partially sealed to the cavity 42 using mechanical means, such as clamps and belts, and/or chemical means, such as adhesives. For example, a belt traversing adjacent to the back surface 24B of the transfer component 24 may be used to operatively engage the transfer component and seal a portion of the transfer component 24 to the cavity 42. The belt may include one or more openings extending from the back surface 24B to the transfer surface 24A such that a device may be used to activate or cure the transfer material and/or to apply force, such as applying a pressurized fluid, to modify the transfer component.

The cavity 42 may include a first support member 140. The first support member 140 may include a first support member portion 144 and a second support member portion 146. The first support member portion 144 and the second support member portion 146 may include a substantially planar surface that provides support of the transfer component from the front face 82 to the article 10 such as illustrated in FIGS. 8A and 8B. The first support member portion 144 and the second support member portion 146 may extend within the opening 87 of the cavity 42. The first support member portion 144 may extend along the first side portion 83 of the front face 82 and from the opening 87 toward the article 10. The second support member portion 146 may extend along the second side portion 84 of the front face 82 and from the opening 87 toward the article 10. The first support member portion 144 may include a first support edge 150 positioned adjacent to the opening 87 and a second support edge 152 positioned adjacent the article 10. The first support edge 150 may have a first edge profile and the second support edge 150 may have a second edge profile. The first edge profile may be different than the second edge profile. The first edge profile may be shaped such that any gap between the opening 87 the first support member portion does not adversely affect the transfer component. The second edge profile may be shaped such that any gap, referred to herein as the support gap 142, between the article 10 and the first support member portion also does not adversely affect the transfer component. The support gap 142 may be the shortest distance between a support edge and the article. The support gap 142 may be less than about 25 mm or less than about 20 mm or less than about 15 mm or less than about 12 mm or less than about 10 mm or less than about 8 mm or less than about 6 mm or less than about 4 mm or less than about 2 mm. It is to be appreciated that the support gap 142 distance may change for any given location on the article. The support gap 142 may be based on the geometry of the article and the geometry of the support member that substantially surrounds the article.

The second support member portion 146 may include a first support edge 156 positioned adjacent to the opening 87 and a second support edge 158 positioned adjacent the article 10. The first support edge 156 may have a first edge profile and the second support edge 158 may have a second edge profile. The first edge profile may be different than the second edge profile. The first edge profile may be shaped such that any gap between the opening 87 the second support member portion does not adversely affect the transfer component. The second edge profile may be shaped such that the support gap 142, the gap between the article 10 and the second support member portion, also does not adversely affect the transfer component. The edge profile of the second support edge 152 of the first support member portion 144 and the edge profile of the second support edge 158 of the second support member portion 146 may be the same or different. Further, the edge profile of the second support edge 152 of the first support member portion 144 and the edge profile of the second support edge 158 of the second support member portion 146 may be substantially the same as a portion of the external profile of the article or different. The second support edge 152 of the first support member portion 144 and the second support edge 158 of the second support member portion 146 may substantially surround a portion of the article 10 minimizing the support gap(s) between the article and the support member. It is to be appreciated that the first support member 140 may engage the article 10 such that no gap is present between the first support member 140 and the article 10.

The support member 140 may include a first support member portion 144 having a third support edge 154 and a second support member portion 146 having a third support edge 160. The third support edge 154 of the first support member portion 144 and the third support edge 160 of the second support member portion 146 may be positioned in facing relationship with the one or more faces of the article that are opposite the target face, or stated another way, the one or more faces in facing relationship with the chamber 89 of the cavity 42. The first support member portion 144 may include a first support surface 151 extending between the first support edge 150 and the second support edge 152 that is configured to support a portion of the transfer component during transfer of the transfer material to the article. The first support member portion 144 may include a second support surface 155 extending between the second support edge 152 and the third support edge 160 that is configured to support the article or a portion thereof during the transfer of the transfer material. The second support member portion 146 may include a first support surface 161 extending between the first support edge 156 and the second support edge 158 that is configured to support a portion of the transfer component during transfer of the transfer material to the article. The second support member portion 146 may include a second support surface 162 extending between the second support edge 158 and the third support edge 160 that is configured to support the article or a portion thereof during the transfer of the transfer material. A support member 140 including multiple support surfaces may have a non-planar surface.

The cavity 42 may include a second support member 164. The second support member 162 may be positioned adjacent to the first support member 140 and may provide support within the opening 87 of the cavity 42 in any portion of the opening 87 in which a gap exists that may adversely affect the transfer component. The second support member 164 may be configured to rotate and/or traverse from a first configuration to a second configuration. In the first configuration the second support member 164 may rotate and/or traverse such that the article may be loaded and/or unloaded into the cavity. In the second configuration, the second support member 164 may rotate and/or traverse such that the article is positioned and held within the cavity and the transfer component may conform to the article having support in the areas surrounding the article such that the transfer component is not adversely affect.

As illustrated in FIGS. 8A and 8B, the second support member 164 may include an upper support member portion 166 and a lower support member portion 168. The upper support member portion 166 may be positioned adjacent to a portion of the first support member portion 144, a portion of the second support member portion 146, and the first clamp portion 77. The lower support member portion 168 may be positioned adjacent to a portion of the first support member portion 144, a portion of the second support member portion 146, and the second clamp portion 78. The upper support member portion 166 may be configured to rotate about a first support member axis 170 to move from a first configuration to a second configuration. More specifically, in the first configuration, the upper support member portion 166 may rotate about the first support member axis 170 such that the upper support member portion 166 is position away from the first clamp portion 77 which allows the first clamp portion 77 to traverse in a direction substantially parallel to the article axis 11. In the second configuration, the upper support portion 166 may be configured to rotate about the first support axis 170 such that the upper support member portion 166 is positioned adjacent the first clamp portion 77 and provides a surface on which to support the transfer component during transfer of the transfer material to the article. Similarly, the lower support member portion 168 may be configured to rotate about a second support member axis 172 to move from a first configuration to a second configuration. More specifically, in the first configuration, the lower support member portion 168 may rotate about the second support member axis 172 such that the lower support member portion 168 is position away from the second clamp portion 78 which allows the second clamp portion 78 to traverse in a direction substantially parallel to the article axis 11. In the second configuration, the lower support member portion 168 may be configured to rotate about the second support axis 172 such that the lower support member portion 168 is positioned adjacent the second clamp portion 78 and provides a surface on which to support the transfer component during transfer of the transfer material to the article.

It is to be appreciated that any number of support members may be positioned about the article 10. The number of support members positioned about the opening of the cavity may be determined, at least in part, based on the movement of the components within the cavity, the cost of manufacturing the cavity, the properties of the transfer component, and the characteristics of the article. It is also to be appreciated that a clamp, as discussed herein, may be integral with or separate from one or more support members.

Figure 9:
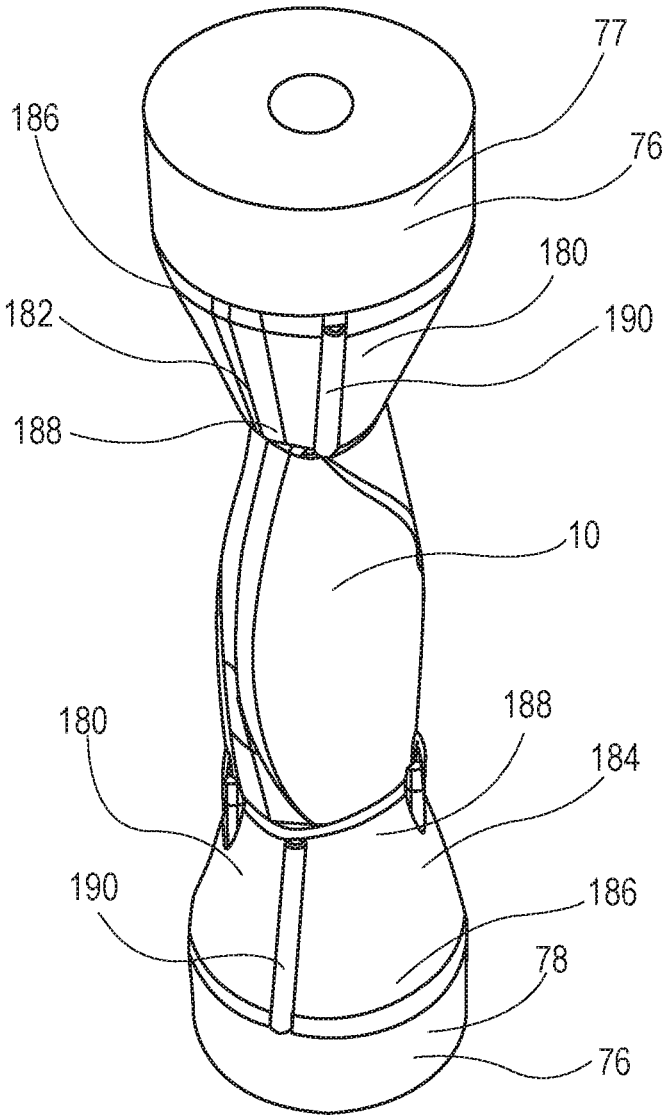
FIG. 9 is a perspective view of an article operatively engaged by a transition member.

The cavity 42 may include a transition member 180 operatively engaged with the clamp 76. The transition member 180 may provide a transition surface between the clamp 76 and the article 10. The transition surface has a substantially tapered surface such that it provides a gradual transition from the exterior profile of the article to the exterior profile of the clamp. It is to be appreciated that an article 10 may include an exterior having an abrupt surface change, such as a right angle or a neck and opening for filing and dispensing product. During transfer of the transfer material, the transfer component may conform to the target surface of the article. An abrupt surface change in the exterior of the article may result in fluid becoming trapped between the target surface or the exterior of the article and the transfer component that is conformed thereto. Further, an abrupt surface change in the exterior of the article may result in breaking, stretching (such as beyond the plastic deformation point of the material), and/or puckering of the transfer component. The transition member 180 may define a fluid tunnel 190 extending from a first end portion 186 to a second end portion 188 of the transition member, such as illustrated in FIG. 9. The fluid tunnel 190 may be used to control the flow of fluid, such as air, as the transfer component conforms to the face of the article 10. The fluid tunnel 190 allows fluid to escape from between the article and the transfer component and, thus, prevent fluid from becoming trapped between the article and the transfer component. It is undesirable for fluid to become trapped between the article and the transfer component. For example, trapped fluid may result in relatively poor adhesion of the transfer material to the article and trapped fluid may be aesthetically unappealing to consumers. Any number of fluid tunnels may be defined by the transition member. It is also to be appreciated that the length and placement of the fluid tunnels may vary and depend, in part, upon the characteristics of the transfer component and the article. The transition member 180 may define a conduit therethrough that is in fluid communication with the conduit extending through the clamp 76. The conduit extending from the clamp 76 and through the transition member 180 may be in fluid communication with the interior of the article, as previously described, and may be used for filling and/or pressurizing the article.

A fluid tunnel 190 is described herein as releasing fluid from between the article and the transfer component. However, it is to be appreciated that it need not be a tunnel but rather, any three-dimensional shape that allows fluid to escape from between the article and the transfer component.

The transition member 180 may include a first transition member portion 182 and a second transition member portion 184, such as illustrated in FIGS. 8A, 8B, and 9. The first transition member portion 182 may include a first end portion 186 and a second end portion 188 opposite the first end portion. The first end portion 186 of the first transition member portion 182 may be operatively engaged with the first clamp portion 77. The portion of the first clamp portion 77 engaged with the first end portion 186 of the first transition member portion 182 may have substantially the same cross-sectional shape or similar cross-sectional shapes such that transition from the clamp to the transition member does not adversely affect the transfer component. Similarly, the second end portion 188 of the first transition member portion 182 may operatively engage the article 10. The edge profile and the cross-sectional shape of the second end portion 188 of the first transition member portion 182 may be substantially the same as the article, such that the first transition member portion 182 fits with the article to provide transition from the article to the clamp that does not adversely affect the transfer component. The first transition member portion 182 may provide a transition surface from the article to the clamp such that the transition component is not adversely affected while being conformed to the target surface of the article and during transfer of the transfer material.

The second transition member portion 184 may include a first end portion 186 and a second end portion 188 opposite the first end portion. The first end portion 186 of the second transition member portion 184 may be operatively engaged with the second clamp portion 78. The portion of the second clamp portion 78 engaged with the first end portion 186 of the second transition member portion 184 may have substantially the same cross-sectional shape or similar cross-sectional shapes such that transition from the clamp to the transition member does not adversely affect the transfer component. Similarly, the second end portion 188 of the second transition member portion 184 may operatively engage the article 10. The edge profile and the cross-sectional shape of the second end portion 188 of the second transition member portion 184 may be substantially the same as the article, such that the second transition member portion 184 fits with the article to provide transition from the article to the clamp that does not adversely affect the transfer component. The second transition member portion 184 may provide a transition surface from the article to the clamp such that the transition component is not adversely affected while being conformed to the target surface of the article and during transfer of the transfer material.

Referring to FIG. 10, the transfer component 24 may transverse in the machine direction. The transfer component 24 may include transfer material 22 disposed thereon. The transfer component 24 may traverse adjacent to the transfer device 48. More specifically, the transfer component 24 may traverse in the machine direction MD such that the transfer surface 24A having the transfer material 22 thereon is in facing relationship with the array of cavities 38. The transfer component 24 may be positioned with respect to each cavity such that the transfer material 22 is positioned within the opening of the cavity 42 and in facing relationship with the target surface 18 of the article 10. The transfer component 24 may engage a sealing portion 120 to position and hold the transfer component such that the transfer material 22 is in position to be transferred to the target surface 18 of the article 10. The sealing portion 120 may allow for other upstream and downstream processes to occur while the portion sealed to the sealing portion and extending within the opening of the cavity remains unaffected by the upstream and downstream processing.

The transfer component 24 with the transfer material 22 thereon have initial dimensions and an initial configuration prior to the modifying step. The terms "modify" or "modifying", as used herein with respect to the transformation that the portion of the transfer component 24 with the transfer material 22 thereon undergoes may include at least one of: (1) changing the dimensions of the portion of the transfer component 24 with the transfer material 22 thereon by increasing their dimensions in at least one direction by stretching the same; (2) changing the dimensions of the portion of the transfer component 24 with the transfer material 22 thereon by reducing their dimensions in at least one direction such as by shrinking or contracting the same; or (3) at least temporarily deforming, deflecting, flexing, or bending a portion of the transfer component 24 with the transfer material 22 thereon to conform to the configuration of the surface 12 of the article 10. The portion of the transfer component 24 that undergoes modification may be an unsupported portion positioned over the opening of the cavity.

The term "modify" may be further specified herein as either including or excluding substantial compression of the thickness of the transfer component 24 as the primary type of modification, or as an aspect of the modification. For example, compression greater than about 5% of the uncompressed thickness of the transfer component 24. It is to be appreciated that although the modification may, for example, be one of stretching to modify the transfer component 24 with the transfer material 22 thereon, the transfer itself may rely on some level of compressive force being applied in the direction of the thickness of the transfer component 24 to ensure good contact for the transfer of the transfer material 22 to the surface 12 of the article. The term "modify" may be further specified as excluding bending or wrapping the transfer component 24 about a cylindrical object. In such cases, the transfer component 24 may be said to be modified other than in the configuration of a portion of a cylindrical surface. That is, if bent, the transfer component 24 with the transfer material 22 thereon is bent such that it may have portions with different radii and/or axes of curvature.

In the various different types of processes described herein, there may be several aspects to transferring the transfer material 22 from the transfer component 24 to the surface of the article 10. As described above, a portion of the transfer component 24 with the transfer material 22 thereon, may be modified. These aspects include: contacting, conforming, and transferring. More specifically, the transfer operation may include contacting the article 10 with the transfer material 22. The transfer operation may include conforming the transfer material 22 to the configuration of the target face 18 of the article 10. The transfer operation may include a transfer of the transfer material 22 from the transfer component 24 to the target face 18 of the article 10. The order in which some of these aspects occur relative to each other may vary depending on the type of process used herein.

The aspect of modifying the transfer component 24 with the transfer material 22 thereon may occur at any of the following times: prior to contact between the article 10 and the transfer material 22; simultaneously with contacting; after contacting; or any combination thereof. The contact may occur in any of the following manners, by: moving, also referred to herein a traversing, the article 10 to make contact with the transfer component 24; moving the transfer component 24 to make contact with the article 10; or moving both the article 10 and the transfer component 24 to contact each other.

The aspect of conforming the transfer material 22 to the configuration of the target face 18 of the article 10 is typically associated with the aspect of modifying the transfer component 24 with the transfer material 22 thereon. The aspect of conforming the transfer material 22 to the configuration of the target face 18 of the article 10 may occur before the transfer material 22 is brought into contact with the surface 12 of the article 10, simultaneously with contacting, or after contacting, or any combination thereof.

The aspect of contacting the article 10 with the transfer material 22 may occur before there is a transfer of the transfer material 22 to the surface 12 of the article 10. The aspect of transferring the transfer material 22 from the transfer component 24 to the target face 18 of the article 10 may occur simultaneously, or after contacting the article 10 with the transfer material 22.

It may be desirable to ensure that the transfer material 22 conforms closely to the surface 12 of the articles 10. This will reduce the chance that there will be wrinkles in the transfer material 22 and that fluid, such as air, gets trapped or entrained between the target face 18 of the article and the transfer material 22. This will also reduce the chance that portions of the transfer material 22 will span, without contacting, between portions of the surface 12 which may have a depression therein, rather than adhering closely to the surface of the article in those depressions. Also, if there is too large of a gap between the transfer material 22 and the article, then the transfer material 22 may not contact the surface 12 of the article 10 and possibly not transfer that portion of the transfer material 22 to the article 10.

The transfer component 24 may be optionally pre-stretched prior to and during the deposit of a material thereon. The transfer component 24 with the transfer material 22 thereon may be temporarily relaxed before conforming the same to the surface of an article 10. Following the relaxation, the transfer component 24 with the transfer material 22 thereon may then be modified, such as by stretching, to conform the same to the surface of an article 10. Applying the transfer material 22 to a pre-stretched transfer component 24 may reduce or eliminate any negative effects on the transfer material during the subsequent step of modifying (such as by stretching) the same when conforming the transfer component 24 with the transfer material 22 thereon to the target face 18 of an article 10. The negative effects may include, but are not limited to, damage to any image on the transfer material, and/or reduction in the quality of the image.

As illustrated in FIG. 10, the transfer component 24 may be in the form of a web having portions that may be maintained by spaced apart sealing portions 120. The articles 10 may contact, such as by traversing and engaging, the transfer component 24 in order to conform the transfer component 24 with the transfer material 22 thereon to the target face 18 of the article 10. The sealing portion 120 may be any suitable type of component that is capable of maintaining a portion of the transfer component 24 in tension so that the article 10 may be moved into the constrained portion of the transfer component 24 to conform the transfer component 24 to at least a portion of the target face 18 of the article 10. The portion of the transfer component may only need to be held in a manner that provides resistance when the article is pushed into the constrained portion of the transfer component 24. The sealing portion 120 may ensure that any stretching of the constrained portion of the transfer component 24 during the conforming is isolated so that adjacent portions of the transfer component 24 are not stretched. The article 10 may be brought into position, such as previously discussed, in proximity with a portion along the length of the transfer component 24 that spans between the opening 87 of the cavity 42 and the sealing portion 120. The article 10 may be pushed into this portion of the transfer component 24 in order to conform the transfer component 24 with the transfer material 22 thereon to the target face 18 of the article 10.

The portion of the transfer component 24 with the transfer material 22 thereon that is isolated by the sealing portion and extends over the opening may have a first initial length L1 measured along its surface 24A before it contacts and conforms to the desired portion of the surface 12 of an article 10. The transfer component 24 with the transfer material 22 thereon may have a second length L2 after it contacts and conforms to the desired portion of the surface 12 of an article 10. It is to be appreciated that the first and second lengths L1 and L2 are measured following along the surface 24A of the transfer component 24, rather than the distance between two points (the dimension lines in the figures are shown merely for ease of illustration). The second length L2 may be greater than the initial length L1 when the transfer component 24 with the transfer material 22 thereon conforms to the surface curvature of an article, such as a three-dimensional article. The transfer material 22 may undergo a similar change in length as that of the transfer component 24.

If the adhesive 52 or, the ink component having adhesive properties is of a type that requires curing to fully adhere to the to the target face 18 of the article 10, the adhesive or ink component may be cured by an energy source 50 positioned adjacent to the cavity 42. The energy source 50 adheres the transfer material 22 to the target face 18 of the article 10. Curing may be done after the article 10 is brought into contact with the transfer material 22 on the transfer component 24.

Figure 11:
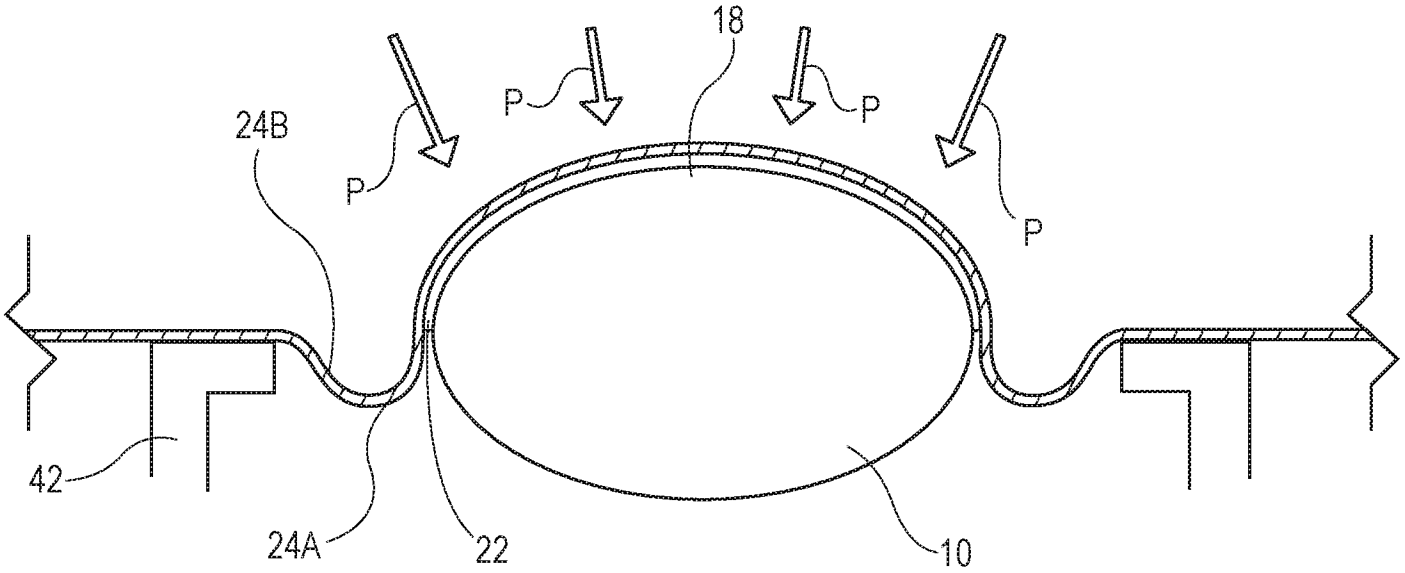
FIG. 11 is an enlarged schematic top view of the transfer component with the transfer material thereon.

Having the transfer component 24 with the transfer material 22 thereon conform to the target surface 18 of the article 10 is important to achieve transfer of the transfer material 22 to the article and to obtain the desired decorated face of the article 10. Thus, additional forces may act on the transfer component 24 or, more specifically, the portion of the transfer component 24 with the transfer material 22 thereon. A force may be applied to the back surface 24B and/or the transfer surface 24A of the transfer component 24. For example, air pressure may be used for bringing the transfer component 24 with the transfer material 22 thereon into closer contact with the surface 12 of the article 10. More specifically, the transfer component 24 with the transfer material 22 thereon is brought into closer contact with the surface 12 of the article 10 by exerting a pushing force on the back surface 24B of the transfer component 24 using air pressure, P, such as illustrated in FIG. 11.

Figure 12:
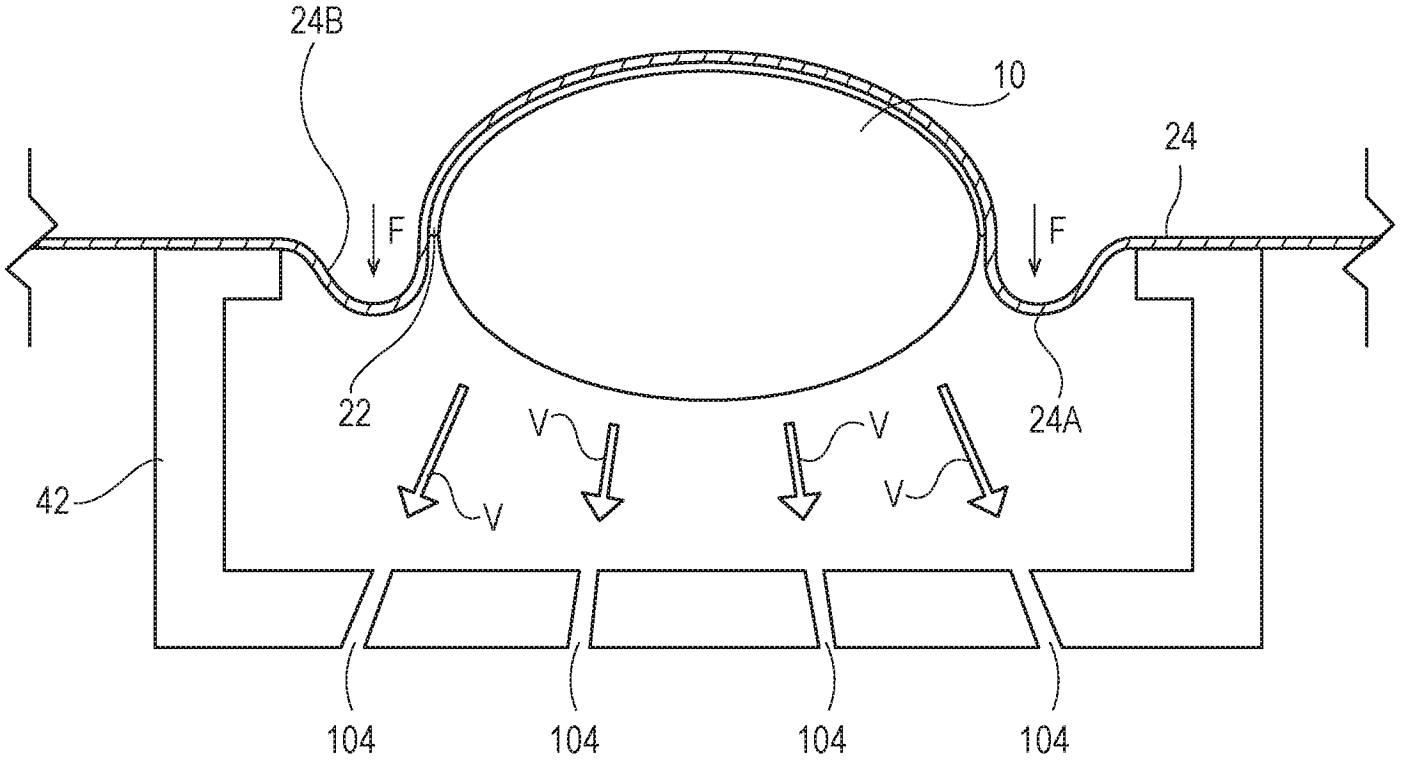
FIG. 12 is an enlarged schematic top view of the transfer component with the transfer material thereon.

FIG. 12 illustrates a force F for bringing the transfer component 24 with the transfer material 22 thereon toward the article 10 and/or into contact with one or more surfaces of the article 10. The force results from lowering the pressure within the cavity as compared to the pressure outside the cavity. As previously discussed, a cavity 24 including a sealing portion 120 may provide a substantially air tight seal around the portion of the transfer component 24. Thus, the portion of the transfer component 24 disposed over the opening 87 of the cavity may be isolated from the surrounding portions of the transfer component 24. A vacuum, V, may be drawn through conduits 104 defined by a portion of the cavity 42 and in fluid communication with a vacuum source. The vacuum V lowers the pressure within the cavity, as compared to the pressure outside the cavity, resulting in the force on the transfer component 24. The force of the transfer component 24 may cause modification of the transfer component, which may include, but is not limited to, moving, stretching, and conforming of the transfer component 24 with the transfer material 22 thereon to one or more surfaces 12 of the article 10.

It is to be appreciated that a pulling force and a pushing force may be used in combination to aid in conforming the transfer component to the article. This may be achieved by other components such as described in U.S. Patent Publication Nos. 2017/0182756 and 2017/0182704.

Figure 13:
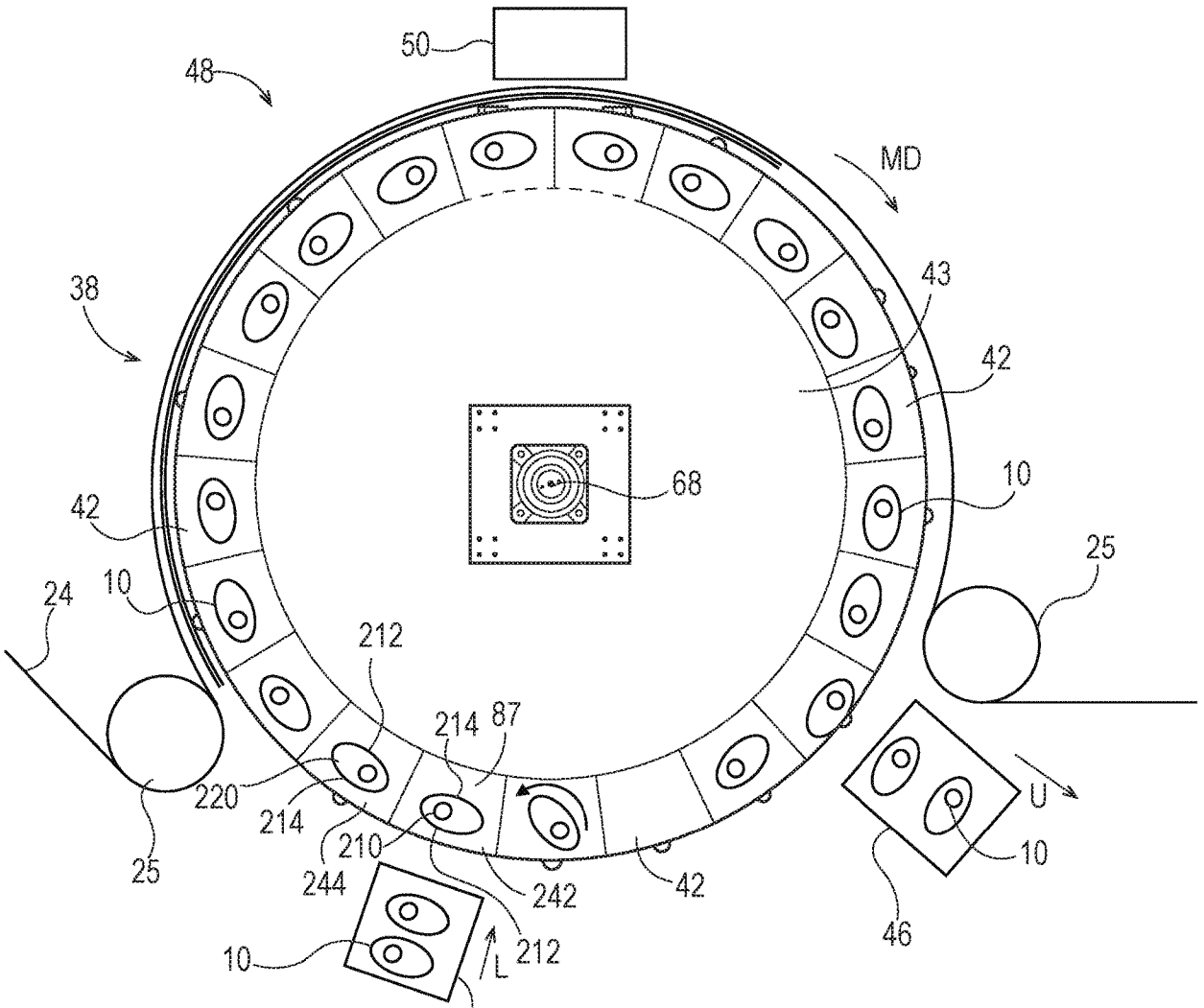
FIG. 13 is a schematic top view of a transfer device.

It is to be appreciated that although the description describes positioning a face to be decorated, the entire face need not be decorated and only a portion of the face, such as one or more surface of the face, may be decorated. Additionally, the description applies to rotating and traversing an article such that the same face is positioned in facing relationship with the transfer component but a different surface on the face may be decorated during a subsequent revolution of the transfer device or a subsequent interaction with the transfer component. Further, the description also applies to decorating the same portion of the same face during multiple revolutions. Referring to FIG. 13, as previously discussed, the transfer material 22 may be transferred from the transfer component 24 to a face, including one or more surfaces 12, of the article 10. Once the transfer material 22 has been transferred to the face of the article 10, the transfer component 24 may be removed from contacting the article 10. The face of the article 10 including the transfer material 22 may be referred to herein as a decorated portion. The transfer component 24 may traverse about an idler 25 and away from the transfer device 48. The article 10 including the decorated portion may traverse toward the unloading station 46. The article 10 including the decorated portion may be unloaded by the unloading station 46 or the article 10 including the decorated portion may traverse past the unloading station 46. The article 10 including the decorated portion that is not unloaded at the unloading station 46 may traverse past the unloading station 46 and may continue about a second revolution of the transfer device 48.

The article 10 including the decorated portion may continue about the second revolution such that the decorated portion is in facing relationship with the transfer component 24 as the article traverses about the transfer device 48. Thus, additional transfer material 22 may be transferred from the transfer component to the article 10 in the area of the article including the decorated portion. The article 10 including the decorated portion may be rotated about an axis, which may be any number of axis, of the article 10 such that one or more surfaces that do not include transfer material(s) is in facing relationship with the transfer component 24. Stated another way, the article including the decorated portion may be rotated such that the decorated portion of the article 10 is not in facing relationship with the transfer material 24 during the second revolution of the transfer device 48 and one or more surfaces 12 of the article 10 may accept transfer material 22 from the transfer component 24 to form a second decorated portion of the article 10. To form the second decorated portion of the transfer component, a second face or second target face may be positioned in facing relationship with the transfer component 24. A portion of the transfer component 24 may contact the second target face of the article 10. The article 10 in contact with the portion of the transfer component 24 may optionally traverse adjacent to the energy source 50 during the second revolution about the transfer device 48. It is to be appreciated that the same energy source used in the first revolution may be used to cure the transfer material 22 that is to be transferred to the second target surface of the article. It is also to be appreciated that the article 10 may traverse any number of revolutions about the transfer device 48. The number of revolutions of the article 10 may be determined, in part, due to the number of surfaces or faces of the article and the complexity of the predetermined pattern to be applied to the surface. Once the article 10 is fully decorated, which may include transfer material applied to one or more faces of the article, the article 10 may be unloaded at the unload station from the cavity of the transfer device and guided to other downstream processes.

As illustrated in FIG. 13, to have a continuous process, for example, different faces of the articles may be decorated in adjacent cavities. More specifically, a first article 210 may be positioned within a first cavity 242. The first article 210 may be positioned within the first cavity 242 such that a first face 212 is in facing relationship with the transfer component 24 and a second face 214 is positioned within the chamber 87 of the first cavity 242. The first face 212 is the target face onto which the transfer material may be transferred to the first article 210. Similarly, a second article 220 may be positioned within a second cavity 244 such that a first face 212 is positioned within the chamber 87 of the second cavity 244 and a second face 214 is in facing relationship with the transfer component 24. The second face 214 is the target face onto which the transfer material may be transferred to the second article 220. It is to be appreciated that the second article 220 may be on its second revolution about the transfer device and, thus, the first face 212 of the second article 220 may have been decorated on a first revolution of the second article 220 about the transfer device. During a first revolution of the transfer device 48, the first face 212 of the second article 220 may have been in facing relationship with a portion of the transfer component and the transfer material on the transfer component may have been transferred to the first face 212 forming a first decorated portion. Once the transfer component 24 was removed from the first face 212 of the second article 220. The second article 202 may have been rotated about an axis of the article such that the first face 121 is rotated to a position in facing relationship with the chamber 87 and the second face 214 is rotated to a position in facing relationship with the transfer component 24.

To place the predetermined pattern on the appropriate face of the first article 210 and the second article 220, the transfer component 24 may include alternating transfer materials 22, which may include different predetermined patterns. The transfer component 24 may include a first transfer material 22 positioned adjacent to the first face 212 of the first article 210 and a second transfer material positioned adjacent to the second face 214 of the second article 220. The first transfer material 22 may be different than the second transfer material 22. It is to be appreciated that the first transfer material may be substantially the same as the transfer material applied to the first face 212 of the second article 220 during the first revolution of the second article 220.

During the second revolution of the transfer device, the first transfer material may contact the first face 212 of the first article 210 and the second transfer material may contact the second face 214 of the second article 220. Each of the first article 210 and the second article 220 may optionally traverse adjacent to an energy source, which cures the transfer material to the face of the article. Upon transfer of the first transfer material to the first face 212 of the first article 210 and transfer of the second transfer material to the second face 214 of the second article 220, the transfer component may be removed from the first and second articles. The first article 210 may continue to traverse past the unloading station such that an additional face of the first article 210 may be decorated on a subsequent revolution of the transfer device and the second article 220, including a first decorated face and a second decorated face, may be unloaded at the unloading station. The empty cavity may then traverse to a loading station, the loading station may load a third article into the cavity and the aforementioned process may repeat during the subsequent revolution of the transfer device. Due to different faces of the articles being decorated during a single revolution of the transfer device, articles may be continuously loaded and unloaded from the transfer device, resulting in a continuous process.

It is to be appreciated that a single article may complete any number of revolutions on the transfer device. However, the number of cavities and the configuration of the transfer material on the transfer device must coordinate with the number of faces of the article to be decorated. It is also to be appreciated that an article may complete various revolutions about the transfer device without being rotated. A single face of the article may receive multiple transfers of multiple transfer materials.

A method for transferring a transfer material from a transfer component to an article may include: traversing an array of cavities in a machine direction; transferring a first article into a first cavity of the array of cavities, wherein the first article comprises a first face and a second face; operatively engaging a portion of the first article with a clamp; advancing a transfer component in the machine direction, wherein the transfer component comprises a first transfer material; positioning the first article such that the first face is in facing relationship with the transfer component; sealing or at least partially sealing a supported portion of the transfer component to a perimeter of the frame; contacting the first face of the first article to the first transfer material; and transferring the first transfer material to the first face of the first article to form a first decorated face of the first article. Prior to or while in contact with the article, the transfer material may be activated. Once the transfer material has been transferred to the article, the transfer component may be removed from the first face of the article. Decorated articles may traverse to an unloading station that may unload those articles that have been decorated and are not intended to include additional decoration as applied about the transfer device. The method may also include: positioning the second face of the first article such that the second face is in facing relationship with the transfer component; sealing a second portion of the transfer component to the perimeter of the frame of the first cavity, wherein a second transfer material of the transfer component is in facing relationship with the second face of the first article; contacting the second face of the first article to the second transfer material; and transferring the second transfer material to the second face of the first article to form a second decorated face of the first article.

A method for decorating an article may include: traversing an array of cavities about a central axis in a machine direction; loading a first article into a first cavity of the array of cavities; decorating a first face of the first article during a first revolution about the central axis; rotating the first article about a first axis; and decorating a second face of the first article during a second revolution about the central axis.

The methods and apparatuses described herein are particularly useful for transfer printing on articles with curved surfaces. For instance, instead of attaching a pre-printed label to an article such as a bottle, the apparatus and method may be used to transfer the subject matter of the label on the article. Of course, the apparatus and method are not limited to printing subject matter which serves as a label on the articles. The apparatus and method are also useful in indirectly printing designs and the like on articles.

The transfer processes and apparatuses described herein may provide a number of advantages. It should be understood, however, that such advantages are not required to be present unless set forth in the appended claims. The processes and apparatuses may be capable of decorating portions of articles that are currently difficult to print by direct printing, or transfer processes. Specifically, the processes described herein is capable of transferring a transfer material from the transfer component to articles with complex three-dimensional shapes and/or which have surface features that differ in height (or depth) by more than a limited extent. The transfer processes described herein provide several advantages over conventional compressible pads that are used for transferring materials, including the advantage that the thickness of the transfer component 24 does not vary extensively when transferring the transfer material to an article, and thus reduces and variations in the printed image that may occur over time due to wear on a compressible pad. The transfer process described herein may also provide advantages over methods that use a conventional transfer pad to transfer the material in which air may be trapped between a depression in the surface of the article and the transfer pad. These and at least some of the other distinctions and advantages over various known methods and articles produced by such methods are described below.

The transfer methods and articles described herein provide advantages over heat transfer label processes and screen printing processes and the articles formed thereby in that heat transfer label processes and screen printing processes are not believed to be capable of forming a continuous image on multiple portions of the surface of a three-dimensional article as described herein. The transfer methods and articles described herein provide advantages over vacuum sublimation processes and hydrographic processes and the articles formed thereby. The inks applied to articles by vacuum sublimation processes penetrate into the surface of the articles, and the inks applied to articles by hydrographic (water transfer printing) processes are etched into the surface of the articles. This makes these articles less suitable or unsuitable for recycling (which requires removal of the inks) than the articles formed by the transfer methods described herein on which the inks are applied on top of the surface (and may follow any contours on the surface, such as small waviness which may be present on plastic surfaces), but do not penetrate into the surface, and thus may be substantially completely removed for recycling and/or during a recycling process.

The transfer methods and articles described herein provide additional advantages over hydrographic processes and the articles formed thereby. Such processes are relatively slow and involve: preparing the surface of the substrate; priming the surface; painting the surface; and, processing the substrate by preparing a printed water-soluble polyvinyl alcohol film which is believed to utilize solvent-based ink, placing the film in a water dipping tank, applying an activator solution to the film to soften the base coat on the substrate, dipping the substrate into the water on top of the film to transfer the printing from the film to the substrate, rinsing and drying the substrate, and applying a clear coating. The transfer methods described herein take place in a non-aqueous environment in which no part of the article is at least partially submerged in water which require that the article be rinsed and dried. The articles described herein may be free of a softenable base coat and an activator (e.g., residual activator).

The transfer methods and articles described herein are also distinguishable from pre-printed thermoforms. Pre-printed thermoforms are articles that are typically made of plastic. After the article is printed, the article with the printing thereon is thermoformed (placed in an oven and formed) into the desired configuration. As a result, the article and the printing thereon are typically stretched the same amount during the thermoforming process.

After the transfer material 22 is transferred to the article(s) 10, the article(s) may be transferred by the conveyor to another conveyor or apparatus for further processing. For example, if the article(s) 10 are bottles, the bottles may be transferred from the conveyor to a filler, and capper.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "90°" is intended to mean "about 90°".

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A method for decorating an article, the method comprising:

traversing an array of cavities about a central axis in a machine direction;

loading a first article into a first cavity of the array of cavities;

decorating a first face of the first article during a first revolution of the first article about the central axis;

rotating the first article about a first article axis within the first cavity;

decorating a second face of the first article during a second revolution of the first article about the central axis; and, comprising traversing a transfer component in the machine direction, wherein the transfer component comprises a transfer material, positioning the transfer component such that the transfer material is in facing relationship with the first face of the first article, deforming a portion of the transfer component such that the transfer material engages the first face of the first article, transferring the transfer material to the first face of the first article, and activating the transfer material; and, wherein the first cavity has a first support edge positioned adjacent to a first cavity opening and a second support edge positioned adjacent the first article, the first support edge having a first edge profile and the second support edge having a second edge profile, the first edge profile being different than the second edge profile, wherein both edge profiles are shaped such that any gap adjacent the first article does not adversely affect the transfer component.

2. The method of claim 1, comprising unloading the first article comprising a first decorated face and a second decorated face.

3. The method of claim 1, comprising rotating the first article about the first article axis and decorating a third face of the first article during a third revolution about the central axis.

4. The method of claim 1, comprising rotating the first article about a second article axis and decorating a third face of the first article during a third revolution about the central axis.

5. The method of claim 1, wherein an odd number of cavities are positioned about the central axis.

6. The method of claim 1, wherein an even number of cavities are positioned about the central axis.

* * * * *